US010124596B2

(12) United States Patent
Kawagoe et al.

(10) Patent No.: US 10,124,596 B2
(45) Date of Patent: Nov. 13, 2018

(54) SUPPLY APPARATUS

(71) Applicant: BROTHER KOGYO KABUSHIKI KAISHA, Nagoya-shi, Aichi-ken (JP)

(72) Inventors: Masako Kawagoe, Nagoya (JP); Yasuo Nishikawa, Nagoya (JP); Yoshinori Osakabe, Seto (JP); Taichi Shirono, Nagoya (JP)

(73) Assignee: BROTHER KOGYO KABUSHIKI KAISHA, Nagoya-Shi, Aichi-Ken (JP)

( * ) Notice: Subject to any disclaimer, the term of this patent is extended or adjusted under 35 U.S.C. 154(b) by 0 days.

(21) Appl. No.: 15/787,421

(22) Filed: Oct. 18, 2017

(65) Prior Publication Data

US 2018/0111382 A1 Apr. 26, 2018

(30) Foreign Application Priority Data

Oct. 21, 2016 (JP) ..... 2016-207324

(51) Int. Cl.
*B41J 2/175* (2006.01)
*B41J 29/13* (2006.01)

(52) U.S. Cl.
CPC ..... *B41J 2/17553* (2013.01); *B41J 2/17513* (2013.01); *B41J 29/13* (2013.01)

(58) Field of Classification Search
CPC ..... B41J 2/17513; B41J 2/17553; B41J 29/13
USPC ..... 347/86
See application file for complete search history.

(56) References Cited

U.S. PATENT DOCUMENTS

2012/0182364 A1* 7/2012 Takeda ..... B41J 2/17506 347/85
2014/0043408 A1 2/2014 Kudo et al.
2015/0352853 A1* 12/2015 Kudo ..... B41J 2/175 347/86
2016/0091820 A1 3/2016 Osakabe et al.
2016/0121615 A1* 5/2016 Igarashi ..... B41J 2/175 347/85

FOREIGN PATENT DOCUMENTS

CN 205130639 U 4/2016
EP 2 962 852 A1 1/2016
JP 2014-37058 A 2/2014
JP 2014_54825 A 3/2014
(Continued)

OTHER PUBLICATIONS

International Search Report and Written Opinion issued in corresponding International Patent Application No. PCT/JP2017/037724, dated Feb. 19, 2018.

*Primary Examiner* — Huan Tran
*Assistant Examiner* — Alexander D Shenderov
(74) *Attorney, Agent, or Firm* — Merchant & Gould P.C.

(57) ABSTRACT

A supply apparatus includes a tank having a front wall, and an inlet via which liquid is poured into the tank; and a cover covering a part of the tank including the front wall, and being formed with an opening to partially expose the front wall of the tank. When the supply apparatus is viewed from the front wall side of the tank, the inlet of the tank and the opening of the cover are arranged to align in an up/down direction. The cover has a first liquid flow channel formed at a periphery of the opening in an inner surface facing the front wall of the tank, and the first liquid flow channel is arranged between the inlet and the opening in the up/down direction.

18 Claims, 12 Drawing Sheets

(56) References Cited

FOREIGN PATENT DOCUMENTS

| | | | |
|---|---|---|---|
| JP | 2016-22725 | A | 2/2016 |
| JP | 2016-22726 | A | 2/2016 |
| JP | 2016-68429 | A | 5/2016 |

* cited by examiner

SUPPLY APPARATUS

CROSS REFERENCE TO RELATED APPLICATION

The present application claims priority from Japanese Patent Application No. 2016-207324 filed on Oct. 21, 2016, the disclosure of which is incorporated herein by reference in its entirety.

BACKGROUND

Field of the Invention

The present invention relates to a supply apparatus which includes a tank to which a liquid can be supplemented via an inlet.

Description of the Related Art

There is known a printer provided with a plurality of tanks which are configured such that inks can be supplemented thereto, and a recording head which is configured to jet, from nozzles, the inks supplied from the tanks so as to record an image on a paper (paper sheet, or sheet) with the jetted ink (for example, the printer disclosed in Japanese Patent Application Laid-open No. 2016-22725). In a case that the ink inside the tank is consumed, a user can supplement the ink stored in a bottle to the tank via an inlet provided in the tank. The user can observe a front wall of the tank by opening a cover, for example. Alternatively, the user can observe the front wall of the tank from the outside of the printer through an opening of the cover. By forming the front wall of the tank by using a translucent member, the user can observe the liquid level of the ink inside the tank through the front wall of the tank.

When the user supplements the ink to the tank, the ink may flow out of the tank. The ink adhering to the outer surface of the tank and/or flowing outside is liable to adhere to the hands and the like of the user. Further, if the ink adheres to the outer surface of the front wall of the tank, then it is difficult to observe the liquid level of the ink inside the tank.

The present teaching has been made in view of the above-described situations, and an object of the present teaching is to provide a supply apparatus which is less likely for a liquid flowing out of the inlet of the tank to contaminate the front wall of the tank.

SUMMARY

According to an aspect of the present teaching, there is provided a supply apparatus including:

a tank having: a liquid storing chamber, an inlet via which liquid is poured into the liquid storing chamber, and a liquid supply portion for causing the liquid to flow out of the liquid storing chamber, the liquid storing chamber being defined by a pair of first surfaces facing each other in a first direction, a front wall connecting the pair of first surfaces and a rear wall which is separated from the front wall in a second direction orthogonal to the first direction and which connects the pair of first surfaces; and a cover covering a part of the tank including the front wall, and being formed with an opening to partially expose the front wall of the tank, wherein when the supply apparatus is viewed from the front wall side of the tank, the inlet of the tank and the opening of the cover are arranged to align in a third direction orthogonal to the first direction and the second direction, the cover has an inner surface facing the front wall of the tank and a first liquid flow channel formed in the inner surface at a periphery of the opening, the first liquid flow channel being arranged between the inlet and the opening in the third direction.

BRIEF DESCRIPTION OF THE DRAWINGS

FIG. 7B is a lower perspective view of the holding member.

DESCRIPTION OF THE EMBODIMENT

Figure 1A:
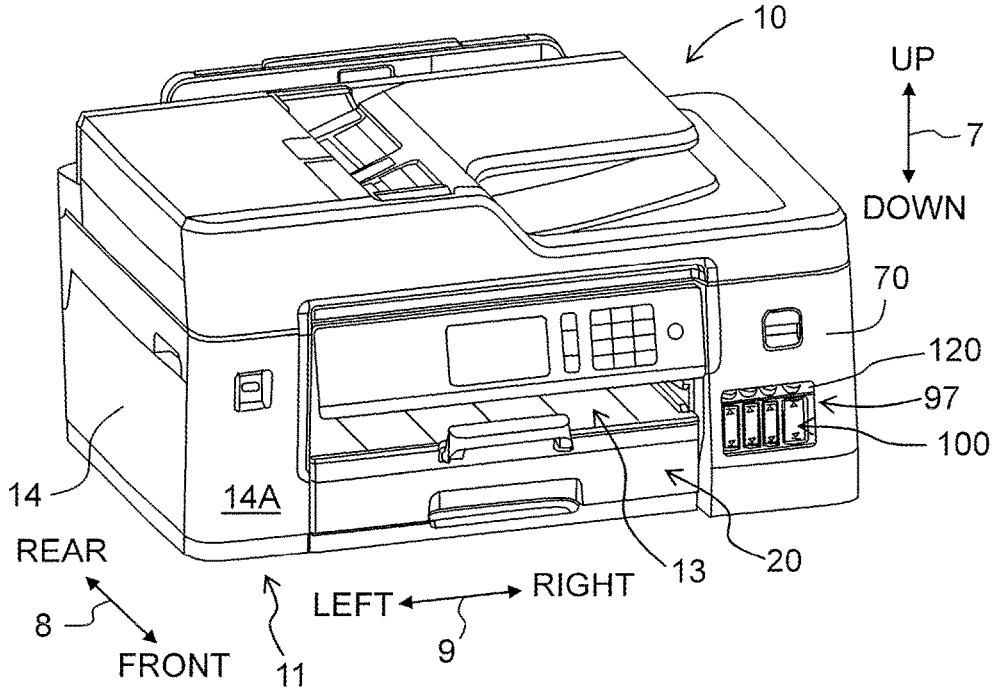
FIG. 1A is a perspective view depicting the outer appearance of a multi-function peripheral where a cover is at a closed position.

In the following, an embodiment of the present teaching will be described, with reference to the drawings. Note that, however, the embodiment described below is merely an example of the present teaching; it goes without saying that it is possible, for example, to make any appropriate change(s) in the embodiment of the present teaching without departing from the gist and/or scope of the present teaching. Further, in the following explanation, advancement (movement) from a starting point to an end point of an arrow is expressed as an "orientation" and coming and going on a line connecting the starting point and the end point of the arrow is expressed as a "direction". In other words, the orientation is a component of the direction. Furthermore, a posture in which the multi-function peripheral 10 and an ink tank 100 stationarily provided (arranged) on the multi-function peripheral 10 are usably installed in a horizontal plane (a posture depicted in FIGS. 1A and 1B) will be referred to as a "usable posture", in some cases. An up/down direction 7 is defined with the usable posture as the reference. Further, a front/rear direction 8 (an example of a second direction) is defined with a side on which an opening 13 of the multi-function peripheral 10 is provided is designated as the frontward side (front surface or front side). A left/right direction 9 (an example of a first direction) is defined as viewing the multi-function peripheral 10 from the frontward side (front surface). In the embodiment, the up/down direction 7 (an example of a third direction) corresponds to the vertical direction, and each of the front/rear direction 8 and the left/right direction 9 corresponds to the horizontal direction in the usable posture.

<Overall Configuration of Multi-function Peripheral 10>

Figure 1B:
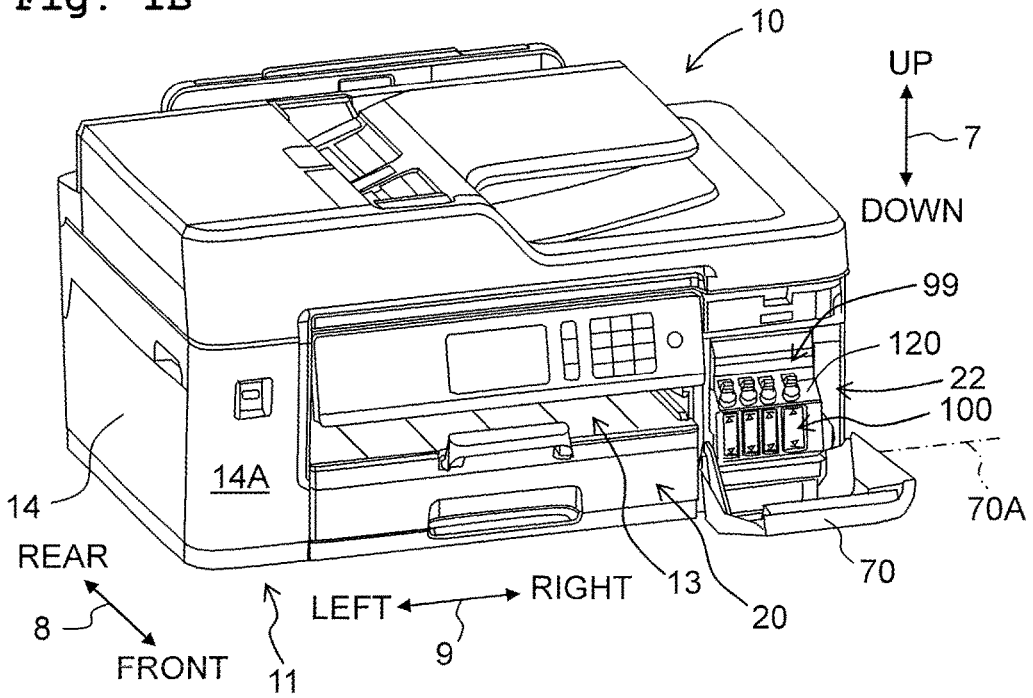
FIG. 1B is a perspective view depicting the outer appearance of the multi-function peripheral where the cover is at an open position.
Figure 2:
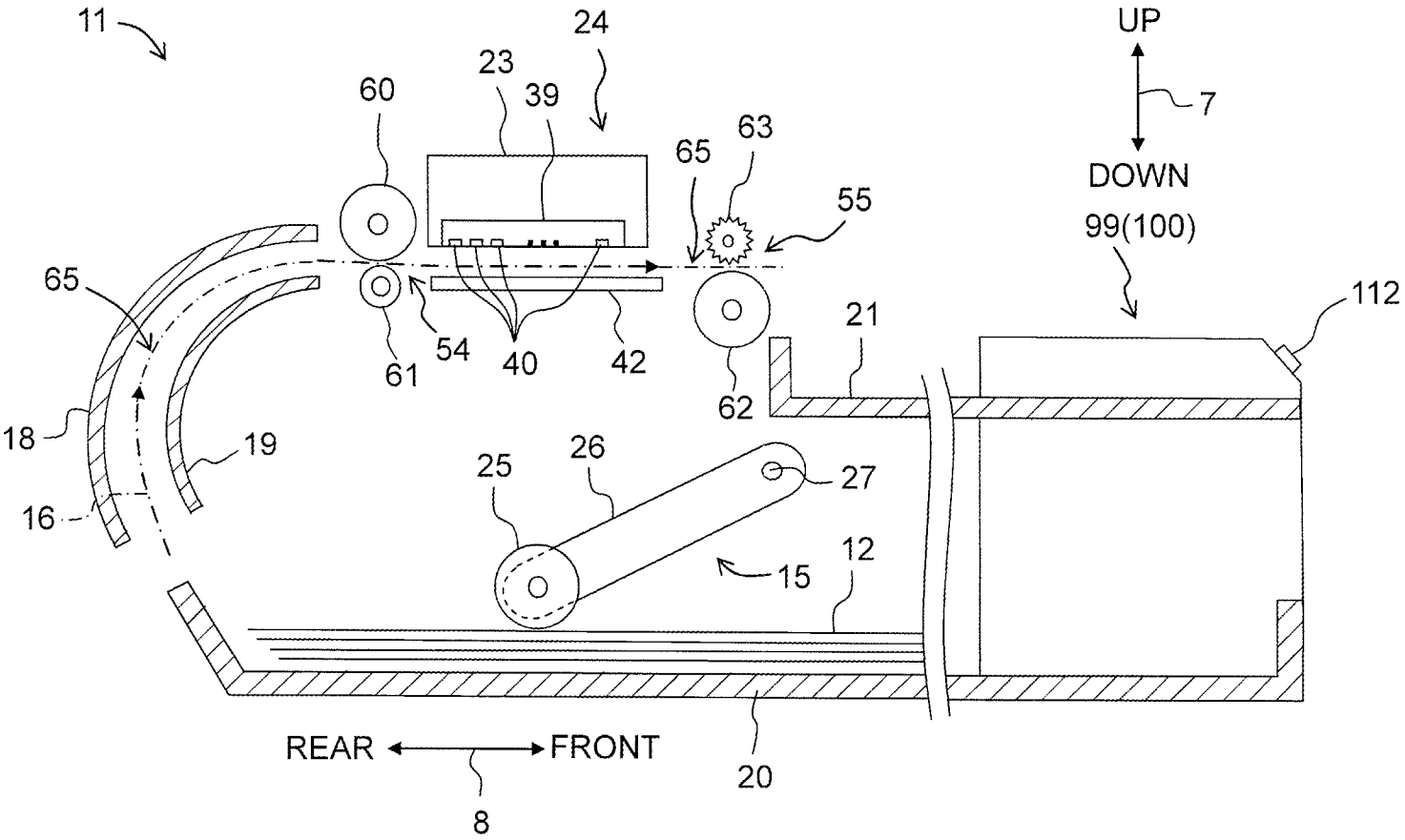
FIG. 2 is a vertical cross-sectional view schematically depicting the internal structure of a printer unit.

As depicted in FIGS. 1A and 1B, the multi-function peripheral 10 (an example of a supply apparatus) is formed to have a substantially rectangular parallelepiped shape. The multi-function peripheral 10 includes, at a lower portion of the multi-function peripheral 10, a printer unit 11 which records an image onto a paper 12 (see FIG. 2) by an ink-jet recording method. The printer unit 11 has a casing 14. An opening 13 is formed in a front wall 14A of the casing 14. As depicted in FIG. 2, a feeding section 15, a feed tray 20, a discharge tray 21, a conveyance roller section 54, a recording section 24, a discharge roller section 55, a platen 42, a tank set 99, a holding member 120 (see FIG. 6), and a connecting member 200 (see FIG. 6) are arranged in the inside of the casing 14. Further, the multi-function peripheral 10 has various functions such as a facsimile function, a print function, etc.

<Feed Tray 20 and Discharge Tray 21>

The opening 13 is formed in the front surface and in a central portion of the multi-function peripheral 10 according to the left/right direction 9. As depicted in FIGS. 1A and 1B, the feed tray 20 can be inserted into or removed from the multi-function peripheral 10 by a user, in the front/rear direction 8 through the opening 13. As depicted in FIG. 2, the feed tray 20 is capable of supporting a plurality of sheets of the paper 12 (sheet 12, paper sheet 12) that are stacked in the feed tray 20. The discharge tray 21 is arranged at a position at the upper side of (above) the feed tray 20, and is extendable and contractable independently from the feed tray 20 regardless of insertion or removal of the feed tray 20. The discharge tray 21 supports the paper 12 discharged through a space between the recording section 24 and the platen 42 by the discharge roller section 55.

<Feeding Section 15>

The feeding section 15 feeds the paper 12 supported by the feed tray 20 to a conveyance route 65 (to be described later on). As depicted in FIG. 2, the feeding section 15 includes a feeding roller 25, a feeding arm 26, and a shaft 27. The feeding roller 25 is rotatably supported by the feeding arm 26 at a front end thereof. The feeding roller 25 rotates in a direction for causing the paper 12 to be conveyed in a conveyance orientation 16 when a conveyance motor (not depicted in the drawings) is reversely rotated. In the following description, the rotations of the feeding roller 25, a conveyance roller 60 (to be described later on), and a discharge roller 62 (to be described later on) in the orientation for causing the paper 12 to be conveyed in the conveyance orientation 16 are each referred to as "normal rotation". The feeding arm 26 is pivotably supported by the shaft 27 supported by a frame of the printer unit 11. A bias is applied to the feeding arm 26 by an elastic force of a spring or by the self-weight of the feeding arm 26 such that the feeding arm 26 is pivoted and urged toward the feed tray 20.

<Conveyance Route 65>

Figure 3:
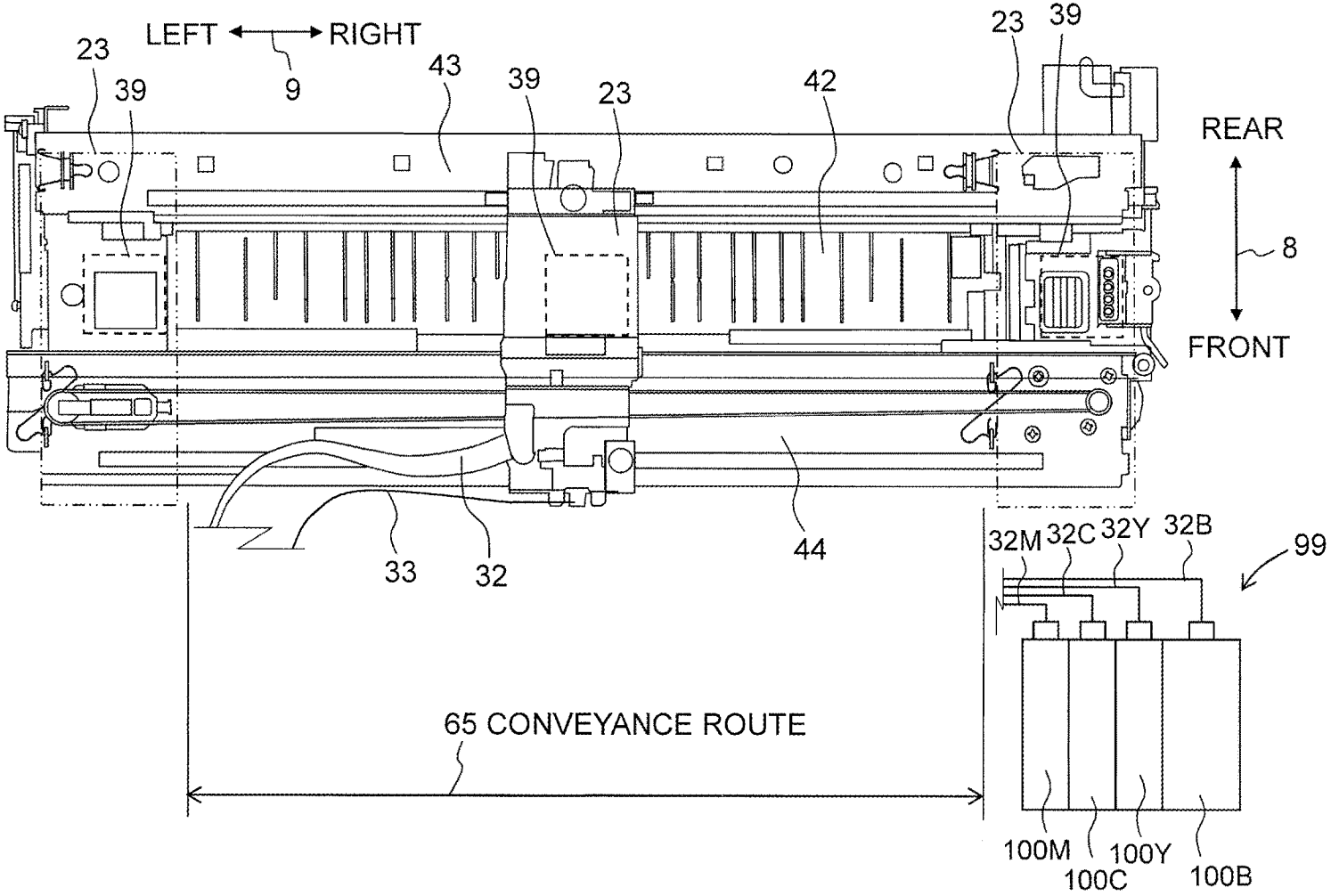
FIG. 3 is a plane view depicting the arrangement of a carriage and a tank set.

As depicted in FIG. 2, the conveyance route 65 is a route or path which extends from a rear-end portion of the feed tray 20 toward the rear side of the printer unit 11, makes a U-turn frontwardly while extending from the lower side to the upper side at the rear side of the printer unit 11, and then reaches the discharge tray 21 via the space between the recording section 24 and the platen 42. In the interior of the printer unit 11, part of the conveyance route 65 is a space formed by an outer guide member 18 and an inner guide member 19 which are arranged to face with each other with a predetermined interval (gap) intervened therebetween. As depicted in FIGS. 2 and 3, a portion of the conveyance route 65 between the conveyance roller section 54 and the discharge roller section 55 is provided at a substantially central portion in the left/right direction 9 of the multi-function peripheral 10, and extends in the front/rear direction 8. In FIG. 2, the conveyance orientation 16 of the paper 12 in the conveyance route 65 is indicated by an arrow of a dot-dash chain line.

<Conveyance Roller Section 54>

As depicted in FIG. 2, the conveyance roller section 54 is arranged at the upstream side of the recording section 24 in the conveyance orientation 16. The conveyance roller section 54 includes a conveyance roller 60 and a pinch roller 61 which are facing each other. The conveyance roller 60 is driven by the conveyance motor. The pinch roller 61 rotates following the rotation of the conveyance roller 60. The paper 12 is conveyed in the conveyance orientation 16 by being pinched between the conveyance roller 60 and the pinch roller 61 which are rotated normally (positively) by the normal rotation of the conveyance motor.

<Discharge Roller Section 55>

As depicted in FIG. 2, the discharge roller section 55 is arranged at the downstream side of the recording section 24 in the conveyance orientation 16. The discharge roller section 55 includes a discharge roller 62 and a spur 63 which are facing each other. The discharge roller 62 is driven by the conveyance motor. The spur 63 rotates following the rotation of the discharge roller 62. The paper 12 is conveyed in the conveyance orientation 16 by being pinched between the discharge roller 62 and the spur 63 which are rotated normally by the normal rotation of the conveyance motor.

<Recording Section 24>

As depicted in FIG. 2, the recording section 24 is arranged between the conveyance roller section 54 and the discharge roller section 55 in the conveyance orientation 16. The recording section 24 is arranged to face the platen 42, while sandwiching the conveyance route 65 therebetween, in the up/down direction 7. The recording section 24 includes a carriage 23 and a recording head 39.

As depicted in FIG. 3, the carriage 23 is arranged to be supported by guide rails 43 and 44 which are separated from each other in the front/rear direction 8, and extended respectively in the left/right direction 9. The guide rails 43 and 44 are supported by the frame of the printer unit 11. The carriage 23 is connected to a known belt mechanism disposed on the guide rail 44. The belt mechanism is driven by a carriage motor (not depicted in the drawings). The carriage 23 connected to the belt mechanism reciprocates in the left/right direction 9 by being driven by the carriage motor. The moving range of the carriage 23 expands to the outside of the conveyance route 65 in the left/right direction 9, as depicted by a dot-dash chain line of FIG. 3.

Further, an ink tube 32 and a flexible flat cable 33 are extended from the carriage 23.

The ink tube 32 connects the tank set 99 to the recording head 39. The ink tube 32 supplies an ink (an example of a liquid) stored in four ink tanks 100B, 100Y, 100C and 100M (which are collectively referred to also as the "ink tank(s) 100" in some cases) constructing the tank set 99, to the recording head 39. The ink tank 100 is an example of a tank. More specifically, four ink tubes 32B, 32Y, 32C and 32M via which inks of black, magenta, cyan and yellow are flowed or distributed are extended from the ink tanks 100B, 100Y, 100C and 100M, respectively, and are connected to the carriage 23 in a bundled form. These four ink tubes 32B, 32Y, 32C and 32M will be collectively referred to as "ink tube(s) 32" in some cases.

The flexible flat cable 33 electrically connects the recording head 39 and a control circuit board having a controller (not depicted in the drawings) mounted thereon. The flexible flat cable 33 transmits a control signal outputted from the controller to the recording head 39.

As depicted in FIG. 2, the recording head 39 is installed on the carriage 23. A plurality of nozzles 40 are arranged (formed) in the lower surface of the recording head 39. End portions (forward end or tip portions) of the nozzles 40 are exposed from the lower surface of the recording head 39. The recording head 39 jets or discharges the ink as fine ink droplets (minute ink droplets) through the nozzles 40. In a process of movement of the carriage 23, the recording head 39 jets the ink droplets toward the paper 12 supported by the platen 42. Accordingly, an image, etc. is recorded on the paper 12. Further, by this jetting of the ink droplets, the ink(s) stored in the ink tanks 100B, 100Y, 100C, and 100M are consumed.

<Platen 42>

As depicted in FIGS. 2 and 3, the platen 42 is arranged between the conveyance roller section 54 and the discharge roller section 55 in the conveyance orientation 16. The platen 42 is arranged so as to face the recording section 24 in the up/down direction 7 with the conveyance route 65 being interposed therebetween, and supports the paper 12, conveyed by the conveyance roller section 54, from therebelow.

<Cover 70>

As depicted in FIG. 1B, an opening 22 is formed in a right portion of the front wall 14A of the casing 14. The cover 70 is fitted to the casing 14 to cover the opening 22. The cover 70 is pivotable between a closed position (the position depicted in FIG. 1A) to close up the opening 22 and an open position (the position depicted in FIG. 1B) to open up the opening 22.

In the lower vicinity of the opening 22 in the casing 14, a pair of projections (not depicted) are formed. The pair of projections face each other in the left/right direction 9. The right projection of the pair projects leftward to the left projection. The left projection of the pair projects rightward to the right projection. By inserting the pair of projections of the casing 14 into holes formed in the cover 70, the cover 70 is supported by the casing 14 in such a manner as pivotable about a pivot axis 70A extending in the left/right direction 9 in the vicinity of the lower end of the casing 14.

An opening 97 is formed in the cover 70. If the cover 70 is at the closed position, then the ink tank 100 and the holding member 120 is partially visible, respectively, from the outside through the opening 97.

<Tank Set 99>

Figure 6:
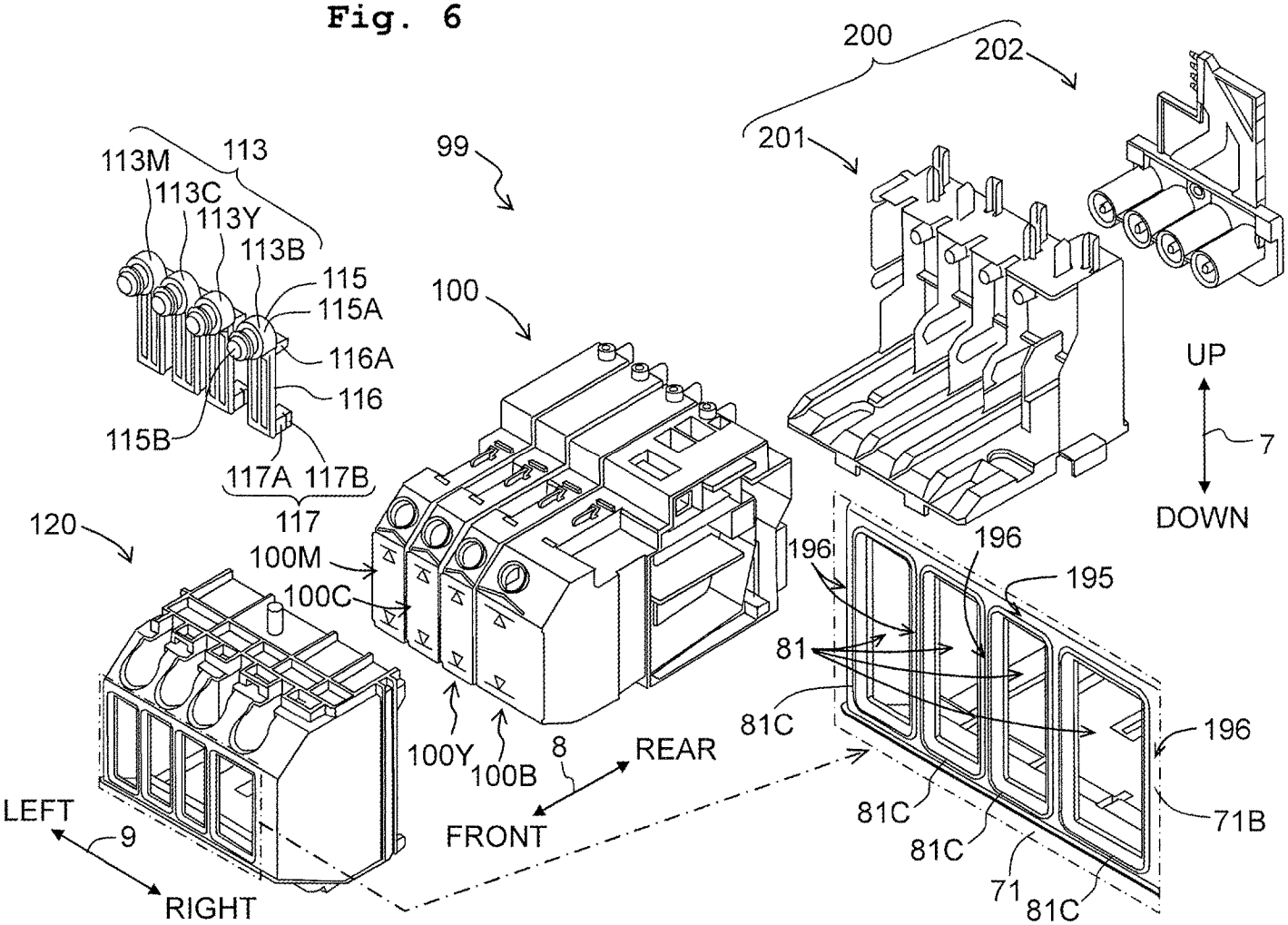
FIG. 6 is an exploded perspective view of the tank set.

The tank set 99 stores the inks to be supplied to the recording head 39. As depicted in FIG. 6, the tank set 99 is provided with the four ink tanks 100B, 100Y, 100C and 100M, the holding member 120, and the connecting member 200.

The ink tanks 100B, 100Y, 100C and 100M store different color inks, respectively. Specifically, a black ink is stored in the ink tank 100B, a yellow ink is stored in the ink tank 100Y, a cyan ink is stored in the ink tank 100C, and a magenta ink is stored in the ink tank 100M. Note that, however, the number of the ink tanks 100 and the number of the colors of the ink are not limited to the above-described example. The configuration of each of the ink tanks 100 will be described later on.

The holding member 120 and the connecting member 200 hold the four ink tanks 100B, 100Y, 100C and 100M in such a state as aligned in one row along the left/right direction 9. The configurations of the holding member 120 and the connecting member 200 will be described later on.

The four ink tanks 100B, 100Y, 100C and 100M are arranged in one row along the left/right direction 9. Among the four ink tanks 100B, 100Y, 100C and 100M, the ink tank 100B is arranged on the rightmost side, and the ink tank 100M is arranged on the leftmost side. Note that the arrangement positons of the ink tanks 100 are not limited to the above-described example. The ink tank 100B for the black ink has the size, in particular, the width in the left/right direction 9, greater than those of the other ink tanks 100Y, 100C and 100M for the color inks. Note that the size magnitude relationship among the ink tanks 100 is not limited to the above-described example. The ink tank 100B has a storing capacity of the ink greater than those of the ink tanks 100Y, 100C and 100M. Note that the storage capacity magnitude relationship among the ink tanks 100 is not limited to the above-described example.

As depicted in FIGS. 1A and 1B, the tank set 99 is arranged stationarily in the inside of a right front portion of the casing 14. In other words, the tank set 99 is fixed to the multi-function peripheral 10 such that the tank set 99 cannot be easily removed (detached) from the multi-function peripheral 10. Note that the phrase "cannot be easily removed (detached) from" means, for example, a situation in which a user cannot easily remove the tank set 99 from the casing 14 of the multi-function peripheral 10 in a state that the multi-function peripheral 10 is in a normal usage state, but does not encompass such a situation in which an experienced repairer removes the tank set 99 from the casing 14 of the multi-function peripheral 10, for example, in order to perform any repair, etc. Accordingly, it is sufficient that the tank set 99 cannot be easily removed, by the user, from the casing 14 of multi-function peripheral 10 in the normal usage state.

<Ink Tank 100>

In the following, the configuration of the ink tank 100 will be explained in detail. Since the ink tanks 100Y, 100C and 100M for the color inks have a same configuration, one of the ink tanks 100Y, 100C and 100M is referred to as the ink tank 100, and the configuration of the one ink tank will be explained. Further, since the configuration of the ink tank 100B for the black ink is similar to that of the ink tanks 100Y, 100C and 100M, the configuration of the ink tanks 100Y, 100C and 100M will be firstly explained, and then the difference between the ink tank 100B and ink tanks 100Y, 100C and 100M will be explained. In this case, a same reference sign or numeral is assigned to a configuration of the ink tank 100B that is similar to a configuration of the ink tanks 100Y, 100C and 100M, even if the shape of the configuration of the ink tank 100B is different from that of the ink tanks 100Y, 100C and 100M to some extent. Note that in the following explanation, the multi-function peripheral 10 and the ink tanks 100 arranged stationarily in the multi-function peripheral 10 are both in the usable posture, unless specifically described otherwise.

As depicted in FIG. 4, the ink tank 100 is constructed of a casing 140 forming the outer shape of the ink tank. The casing 140 is provided with a tank body 141, and two films 142 and 143.

The tank body 141 has, as a whole, a shape that is flat, rectangular parallelepiped in which a size in the left/right direction 9 is short, and sizes in the up/down direction 7 and the front/rear direction 8, respectively, are longer than the size in the left/right direction 9. Further, the size in the front/rear direction 8 is longer than the size in the up/down direction 7.

The tank body 141 is formed of a resin which has a transparency or translucency to light to such an extent that an ink inside an ink chamber 111 (to be described later on) is visible from the outside of the ink tank 100. The tank body 141 is formed of polypropylene, for example. The tank body 141 is integrally formed by, for example, performing injection molding of a resin material. The rigidity of the tank body 141 is higher than that of the films 142 and 143.

Note that the tank body 141 may be formed of a material different from resin. Further, the tank body 141 may have a configuration in which a plurality of members are combined.

The tank body 141 is provided with a front wall 101, a left wall 103, an upper wall 104, a lower wall 105, a rear wall 110, and an inner wall 107.

The front wall 101 is constructed of a standing wall 102 and an inclined wall 106. The standing wall 102 expands in the up/down direction 7 and the left/right direction 9. The inclined wall 106 connects an upper end of the standing wall 102 and a front end of the upper wall 104. The inclined wall 106 is inclined with respect to the up/down direction 7 and the front/rear direction 8. That is, the inclined wall 106 is formed successively with the standing wall 102 and, furthermore, when the ink tank body 141 is viewed from the side of the front wall 101, the standing wall 102 and the inclined wall 106 are arranged to align in the up/down direction 7.

In each of the ink tanks 100, the standing wall 102 has a front surface 102A while the inclined wall 106 has a front surface 106A both of which are exposed to the outside of the multi-function peripheral 10 via the opening 97 of the cover 70 and the opening 22 of the casing 14. That is, the front surface (an example of the second surface) of the tank body 141 of each of the ink tanks 100 faces outward from the casing 14. That is, each of the ink tanks 100 is arranged inside the casing 14 so as to be accessible to the front surface of the tank body 141 from the outside of the casing 14 via the opening 22 and the opening 97. By such a configuration, the front surface of the tank body 141 of each ink tank 100 is visible from the front side of the multi-function peripheral 10 such that the user can confirm the remaining amount of the ink stored in each ink tank 100.

The left wall 103 extends rearwardly (in the rear direction) from a left end of the front wall 101. An upper end of the left wall 103 is connected to a front portion of the upper wall 104. A lower end of the left wall 103 is connected to a front portion of the lower wall 105. In other words, the left wall 103 connects a left end of the front wall 101, a front left end of the upper wall 104 and a front left end of the lower wall 105 to one another. Namely, the left wall 103 is provided only on a front portion of the tank body 141, but is not provided on a rear portion of the tank body 141.

The upper wall 104 extends rearwardly from an upper end of the front wall 101 (rear end of the inclined wall 106). A front portion of the upper wall 104 is connected to an upper end of the left wall 103.

The lower wall 105 is a wall which extends rearwardly from a lower end of the front wall 101. The lower wall 105 is formed to be away from the upper wall 104 to be positioned below the upper wall 104 in the up/down direction 7. As described above, the front portion of the lower wall 105 is connected to the lower end of the left wall 103.

A plurality of inner walls 107 are arranged in the space enclosed by the front wall 101, the left wall 103, the upper wall 104, the lower wall 105, and the rear wall 110.

Figure 4A:
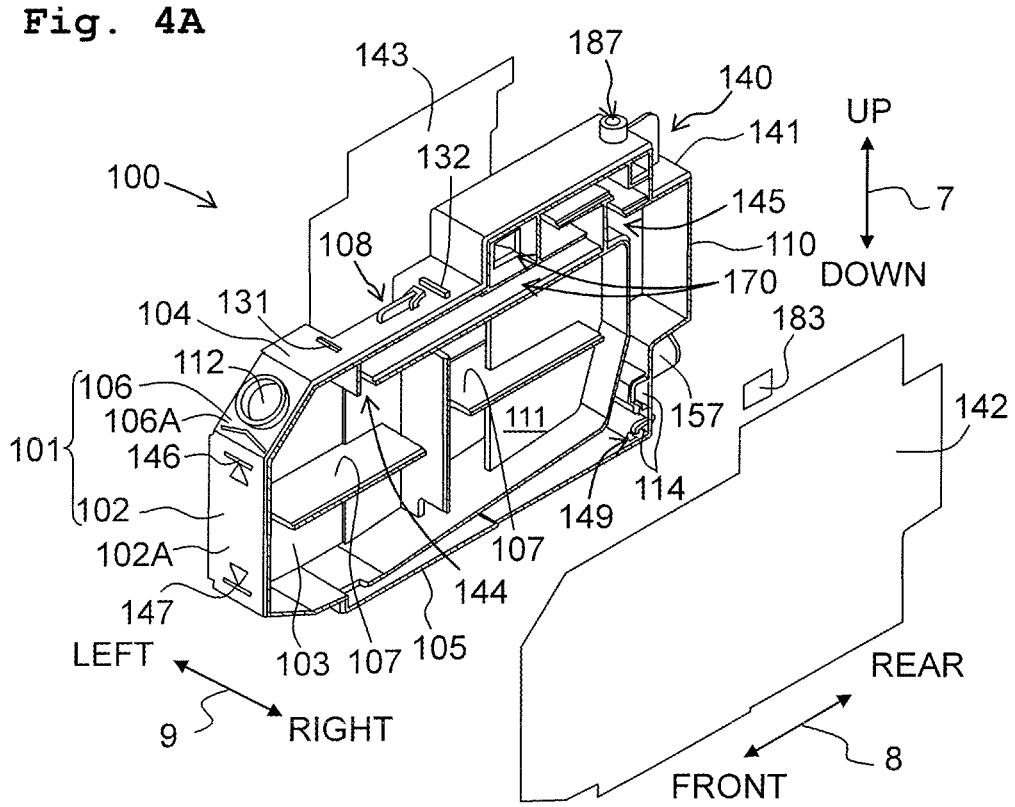
FIG. 4A is a front perspective view of an ink tank for a color ink.

As depicted in FIG. 4A, the right surface of the tank body 141 is open (uncovered, released). By fixing a film 142 by welding to the right surfaces of the front wall 101, the lower wall 105, the rear wall 110, the upper wall 104, the inner walls 107, the right surface of the tank body 141 is sealed.

Figure 4B:
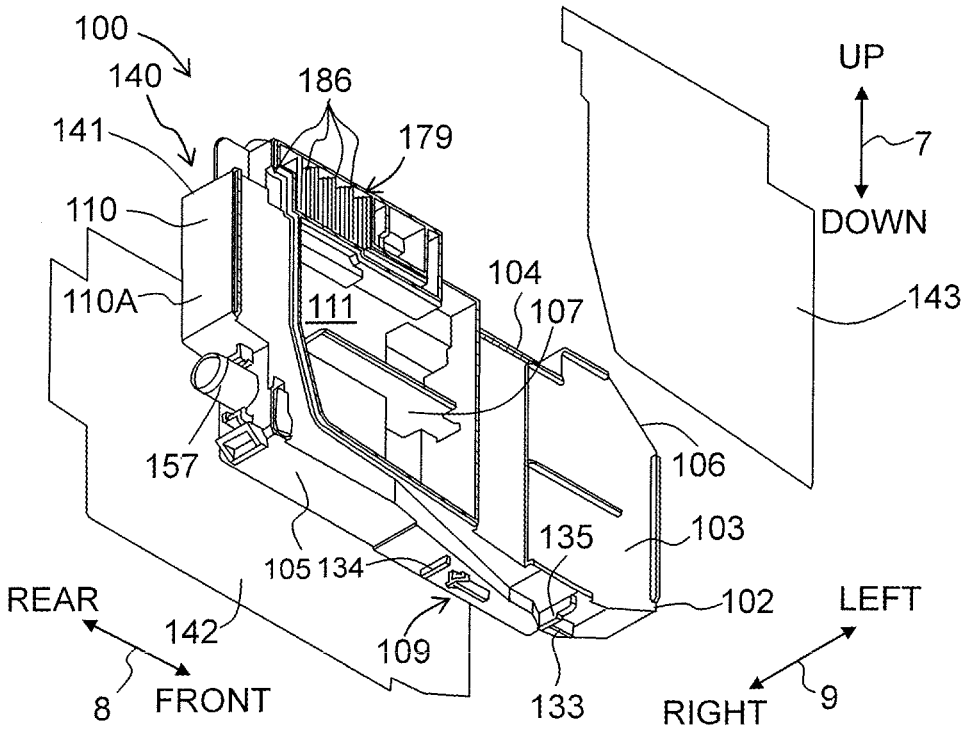
FIG. 4B is a rear perspective view of the ink tank for the color ink.

As depicted in FIG. 4B, the rear portion of the left surface of the tank body 141 is open (uncovered, released). By fixing a film 143 by welding to the left surfaces of the lower wall 105, the rear wall 110, the upper wall 104, the inner walls 107, the left surface of the tank body 141 is sealed.

The front surface of the tank body 141 (the front surface 102A of the standing wall 102 and the front surface 106A of the inclined wall 106) is connected by the front end of the right surface of the tank body 141 and the front end of the left surface of the tank body 141. The rear surface of the tank body 141 (the rear surface 110A of the rear wall 110) is connected by the rear end of the right surface of the tank body 141 and the rear end of the left surface of the tank body 141. The rear surface 110A of the tank body 141 is separate from the front surface 102A in the front/rear direction 8. The rear surface 110A is an example of the third surface. The right surface of the tank body 141 faces the left surface of the tank body 141 in the left/right direction 9. The left surface and the right surface of the tank body 141 are an example of a pair of first surfaces.

As depicted in FIG. 4A, the front surface 102A of the standing wall 102 of the front wall 101 is provided with a first line 146 (an example of the first mark) and a second line 147 (an example of the second mark).

The first line 146 extends in the left/right direction 9. Under a condition that a maximum amount of the ink (an example of the first amount), which is an amount of the ink storable in the ink tank 100 in the usable posture of the multi-function peripheral 10, is stored in the ink chamber 111, the position in the up/down direction 7 of the first line 146 is at a height which is same as the liquid surface of the maximum amount of the ink. That is, the first line 146 is provided at such a position (an example of the first position) as to correspond to the liquid surface of the ink stored in the ink chamber 111 at the maximum amount. Note that the position in the up/down direction 7 of the first line 146 is not limited to the liquid surface of the maximum amount of the ink under the condition that the maximum amount of the ink is stored in the ink chamber 111.

The second line 147 extends in the left/right direction 9. The second line 147 is located to be below the first line 146 in the up/down direction 7. Specifically, under a condition that an amount which is smaller than the maximum amount of the ink is stored in the ink chamber 111 in the ink tank 100 in the usable posture of the multi-function peripheral 10, the position in the up/down direction 7 of the second line 147 is at a height which is same as the liquid surface of the amount of the ink which is smaller than the maximum amount. In the embodiment, under a condition that a minimum storing amount of the ink (an example of the second amount), which requires supplement of the ink, is stored in the ink chamber 111 in the ink tank 100 in the usable posture, the position in the up/down direction 7 of the second line 147 is at a height which is same as the liquid surface of the minimum storing amount of the ink. That is, the second line 147 is provided at such a position (an example of the second position) as to correspond to the liquid surface of the ink stored in the ink chamber 111 at the minimum amount.

<Ink Chamber 111>

As depicted in FIGS. 4A and 4B, the casing 140 has the ink chamber 111 (an example of the liquid storing chamber) in the inside thereof. The ink chamber 111 is an internal space of the ink tank 100 and an ink is stored in the ink chamber 111. The ink chamber 111 is defined by the front wall 101, the left wall 103, the upper wall 104, the lower wall 105, the rear wall 110, the inner wall 107, the film 142, and the film 143. That is, the ink chamber 111 is defined by the right surface of the tank body 141, formed of the film 142, and the left surface of the tank body 141, formed of the left wall 103 and the film 143.

In the embodiment, the right surface of the ink chamber 111 is defined by the left surface of the film 142. That is, the entire right surface of the ink chamber 111 is formed of the film 142. Further, the left surface of the ink chamber 111 is defined by the right surface of the film 143 and the right surface of the left wall 103. That is, part of the left surface of the ink chamber 111 is formed of the film 143. The ink chamber 111 is divided into a plurality by the inner wall 107.

Further, the right surface of the ink chamber 111 may be defined by the film 142 and another wall. That is, part of the right surface of the ink chamber 111 may be formed of the film 142. Further, the left surface of the ink chamber 111 may be defined only by the film 143. That is, the entire left surface of the ink chamber 111 may be formed of the film 143.

Under the condition that the maximum amount of the ink (an example of the first amount), which is the amount of the ink storable in the ink tank 111, is stored in the ink chamber 111, when the multi-function peripheral 10 is in the usable posture, in other words, in the state where the upper wall 104 constitutes the upper portion of the ink tank 100 and the lower wall 105 constitutes the lower portion of the ink tank 100, the liquid surface of the ink is at the same height as the first line 146.

Under the condition that the minimum amount of the ink (an example of the second amount), which requires supplement of the ink to the ink chamber 111, is stored in the ink chamber 111, when the multi-function peripheral 10 is in the usable posture, in other words, in the state where the upper wall 104 constitutes the upper portion of the ink tank 100 and the lower wall 105 constitutes the lower portion of the ink tank 100, the liquid surface of the ink is at the same height as the second line 147.

As shown in FIGS. 4A and 4B, the upper wall 104 is formed with a projection 108, projections 131 and 132. Further, the lower wall 105 is formed with a projection 109, a projection 133, a projection 134, and a projection 135.

<Ink Outflow Channel 114>

As depicted in FIG. 4A, the casing 140 has an ink outflow channel 114. The ink outflow channel 114 is a communicating channel (path or route) via which the ink stored in the ink chamber 111 is allowed to flow out of the ink tank 100.

One end of the ink outflow channel 114 is communicated with the ink chamber 111 via openings 149 and 150 (see FIGS. 4A and 10) formed in the border between the lower wall 105 and the rear wall 110. The other end of the ink outflow channel 114 is communicated with a projecting portion 157 (an example of the liquid supply portion) via an opening 156 (see FIG. 10) formed in the rear wall 110. The opening 156 is positioned above the openings 149 and 150.

Figure 10:
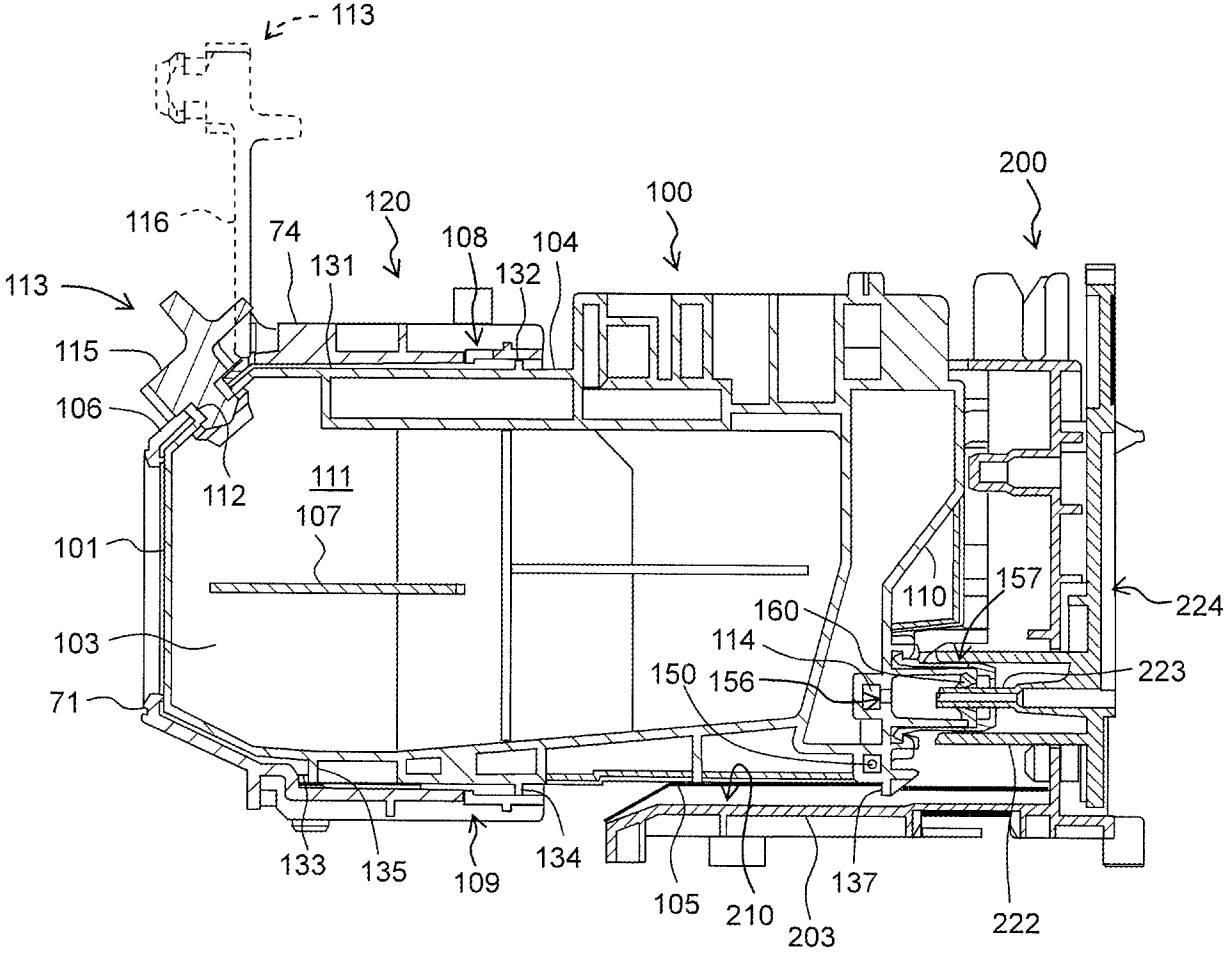
FIG. 10 is a vertical cross-sectional view depicting a state of the connecting member fitted with each of the ink tanks held by the holding member.

As depicted in FIG. 10, the projecting portion 157 projects rearward from a surrounding part of the opening 156 of the rear surface 110A of the rear wall 110, that is, outward from the ink tank 100. Here, when the tank set 99 is in a state of being stationarily provided inside the casing 14 of the multi-function peripheral, the rear surface 110A of the rear wall 110 faces inward to the casing 14. That is, the projecting portion 157 projects inward to the casing 14. The projecting portion 157 is hollow inside. The front end of the inner space of the projecting portion 157 is communicated with the ink outflow channel 114 through the opening 156. The rear end of the inner space of the projecting portion 157 is communicated with the outside of the ink tank 100 through the opening.

As depicted in FIG. 10, the projecting end of the projecting portion 157 is provided with a sealing member 160. The sealing member 160 is a disk-like member which is elastic such as rubber or the like. The sealing member 160 is in liquid-tight contact with the projecting end of the projecting portion 157. A through hole is formed in the center of the sealing member 160. An ink needle 223 of the connecting member 200 is inserted in the through hole of the sealing member 160, with the ink tank 100 being stationary inside the casing 14. The ink needle 223 is connected with the ink tube 32 directly or indirectly. By virtue of this, the ink, which has entered the inner space of the projecting portion 157 from the ink outflow channel 114 through the opening 156, flows to the ink tube 32 through the ink needle 223.

In the above manner, the ink stored in the ink chamber 111 is communicated with the nozzles 40 of the recording head 39 via the ink outflow channel 114, the inner space of the projecting portion 157, the ink needle 223, and the ink tube 32.

<Atmosphere Communicating Channel 170>

As depicted in FIG. 4A, the casing 140 has an atmosphere communicating channel 170. The atmosphere communicating channel 170 communicates the ink chamber 111 with the outside of the ink tank 100. In other words, the atmosphere communicating channel 170 releases (opens) the ink chamber 111 to the atmosphere.

One end of the atmosphere communicating channel 170 is communicated with the ink chamber 111 through the openings 144 and 145. The other end of the atmosphere communicating channel 170 is communicated with an atmosphere open port 187 formed in the upper wall 104.

Between the one end and the other end of the atmosphere communicating channel 170, a semipermeable membrane 183 is attached to block the atmosphere communicating channel 170. The semipermeable membrane 183 is a porous membrane (film) having minute (fine) holes which shut off passing of the ink therethrough and allow a gas to pass therethrough. For example, the semipermeable membrane 183 is formed of a fluoro resin such as polytetrafluoroethylene, polychlorotrifluoro-ethylene, tetrafluoroethylene-hexafluoropropylene copolymer, tetrafluororethyelen-perfluoro alkylvinylether copolymer, tetrafluoroethylene-ethylene copolymer, etc. By virtue of this, the ink stored in the ink chamber 111 is blocked by the semipermeable membrane 183 and thereby is not allowed to flow out of the ink tank 100 through the atmosphere open port 187. On the other hand, air is movable freely between the inside of the ink chamber 111 and the outside of the ink tank 100.

Between the atmosphere open port 187 and the position where the semipermeable membrane 183 is attached in the atmosphere communicating channel 170, a labyrinth 179 is formed as shown in FIG. 4B. The labyrinth 179 is a communicating channel extending along the front/rear direction 8 while repeatedly making U-turns in the up/down direction 7 by providing a plurality of partition walls 186 extending in the up/down direction 7 to align in the front/rear direction 8.

<Inlet 112>

An inlet 112 is formed in the inclined wall 106 of the ink tank 100 for inletting the ink to the ink chamber 111. The inlet 112 penetrates through the inclined wall 106 in a direction of the thickness of the inclined wall 106, and makes the ink chamber 111 communicate with the outside of the ink tank 100.

The inclined wall 106 and the inlet 112 are exposed to the outside of the multi-function peripheral 10 through the opening 22 by way of locating the cover 70 at the open position. The ink tank 100 is in the usable posture (inlet posture) when the ink is inlet to the ink chamber 111 through the inlet 112. That is, when the ink tank 100 is in the usable posture, the ink can be inlet to the ink chamber 111 through the inlet 112.

<Ink Tank 100B>

Figure 5A:
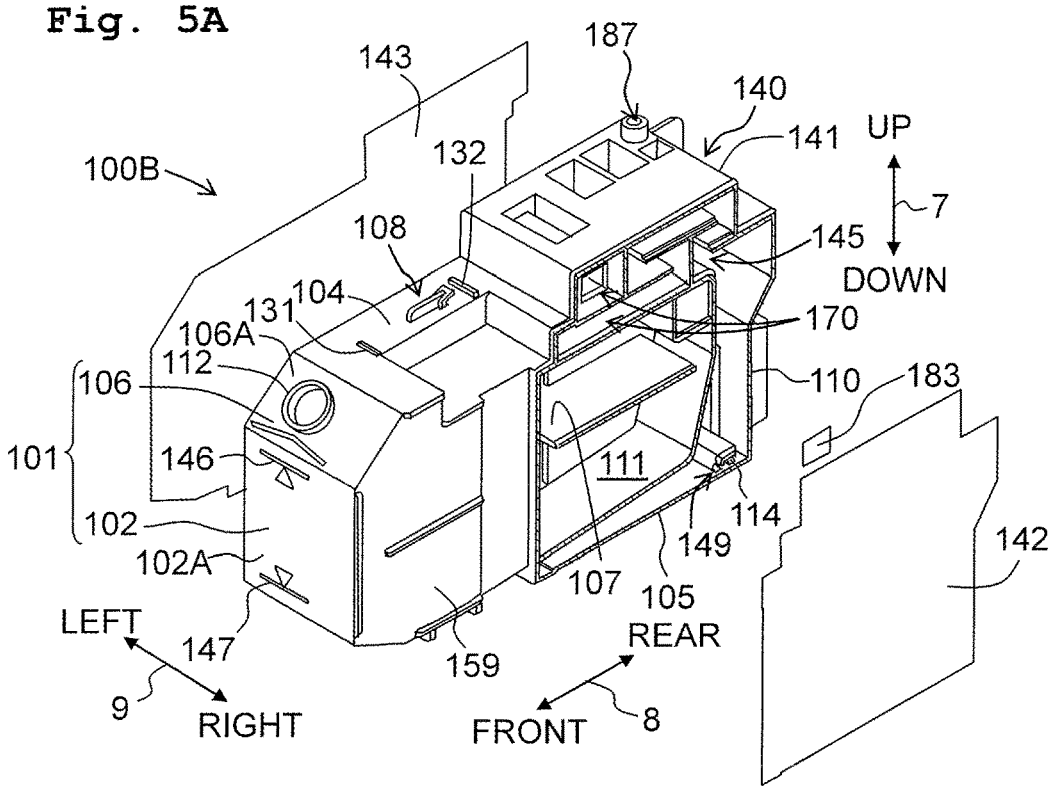
FIG. 5A is a front perspective view of an ink tank for a black ink.
Figure 5B:
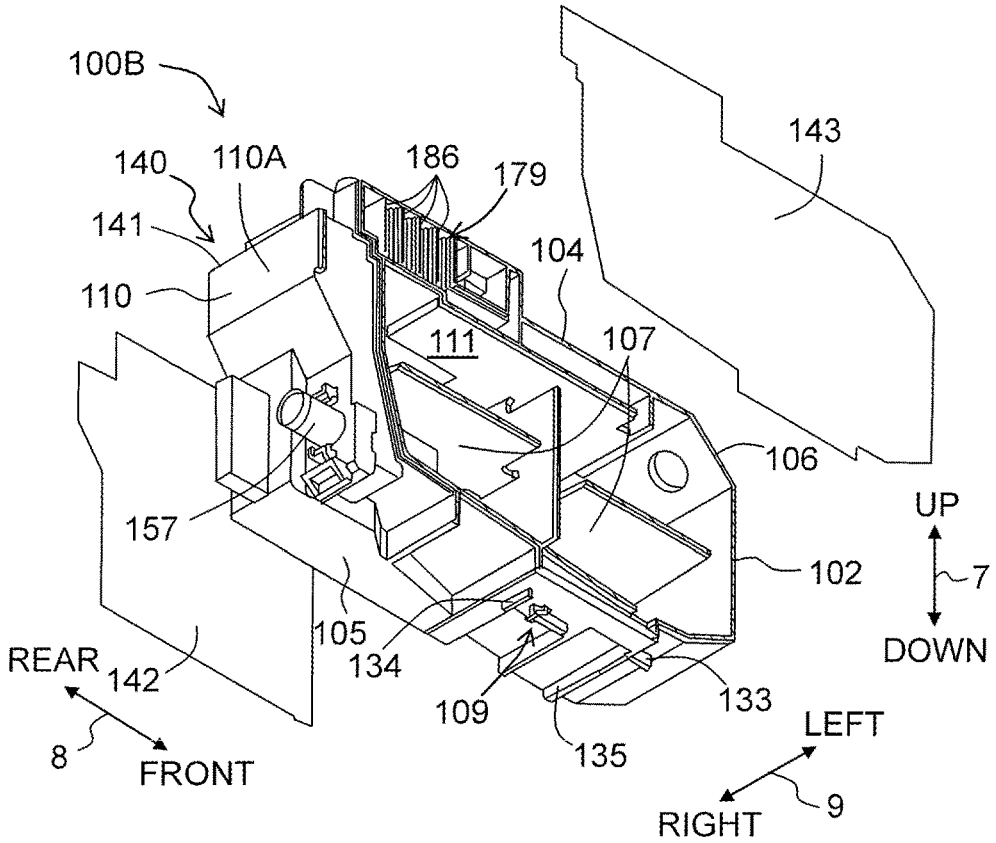
FIG. 5B is a rear perspective view of the ink tank for the black ink.

In the following, the configuration of the ink tank 100B will be explained with reference to FIGS. 5A and 5B. As depicted in FIGS. 5A and 5B, the ink tank 100B has a length in the left/right direction 9 which is longer than those of the ink tanks 100Y, 100C and 100M (see FIGS. 4A and 4B).

In the following, regarding the ink tank 100B, an explanation will be given about the difference between the ink tank 100B and the ink tanks 100Y, 100C and 100M. Note that regarding a configuration, a portion, a part, a component, etc., of the ink tank 100B which is (are) same as that of each of the ink tanks 100Y, 100C and 100M, a same reference sign or numeral in FIGS. 4A and 4A is assigned to the configuration, etc., of the ink tank 100B that is same as those of the ink tanks 100Y, 100C and 100M, and any explanation therefor will be omitted. Further, in a case that the difference between the configuration of a predetermined (certain) portion or part of the ink tank 100B and those of the ink tanks 100Y, 100M and 100C corresponding thereto is only the point that the configuration of the predetermined portion or part of the ink tank 100B is longer in the left/right direction 9 than those of the ink tanks 100Y, 100M and 100C, then a same reference sign or numeral in FIGS. 4A and 4B is assigned to the configuration of the predetermined portion or part of the ink tank 100B, and any explanation therefor will be omitted.

As depicted in FIGS. 5A and 5B, the ink tank 100B is not provided with the left wall 103 (see FIG. 4B) which is provided on each of the ink tanks 100Y, 100C and 100M, but the ink tank 100B is provided with a right wall 159 (an example of the side wall). The right wall 159 extends rearwardly from a right end of the front wall 101. An upper end of the right wall 159 is connected to a front portion of the upper wall 104. A lower end of the right wall 159 is connected to a front portion of the lower wall 105. In other words, the right wall 159 connects the right end of the front wall 101, the front right end of the upper wall 104 and the front right end of the lower wall 105. Namely, the right wall 159 is provided only on the front portion of the tank body 141, but is not provided on the rear portion of the tank body 141.

<Holding Member 120>

As depicted in FIG. 6, the holding member 120 (an example of the cover) holds the four ink tanks 100B, 100Y, 100C, and 100M in such a state as aligned in one row in the left/right direction 9 from the front side according to the front/rear direction 8.

Figure 7A:
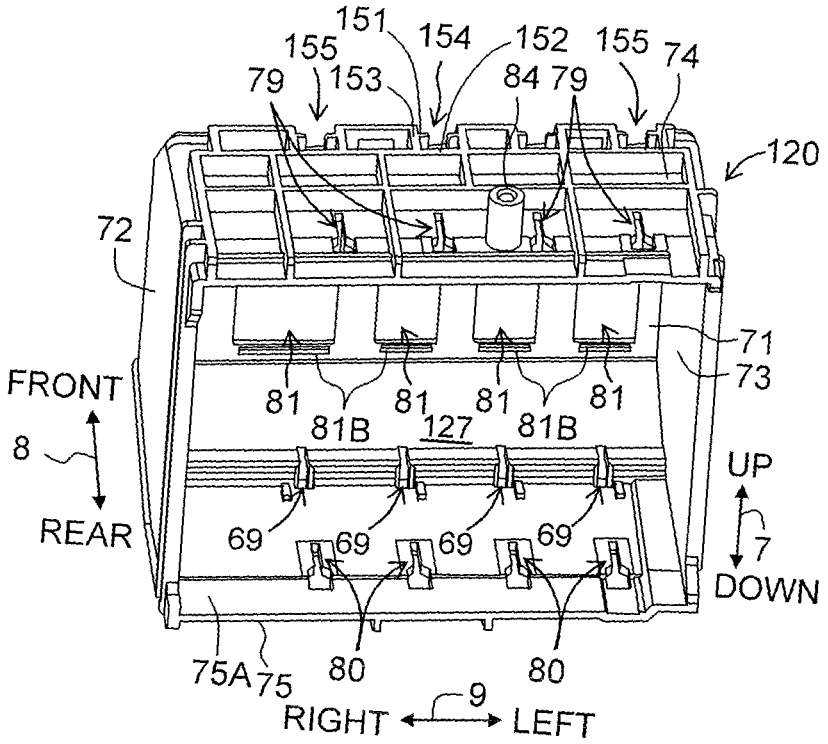
FIG. 7A is an upper perspective view of a holding member.
Figure 7A:
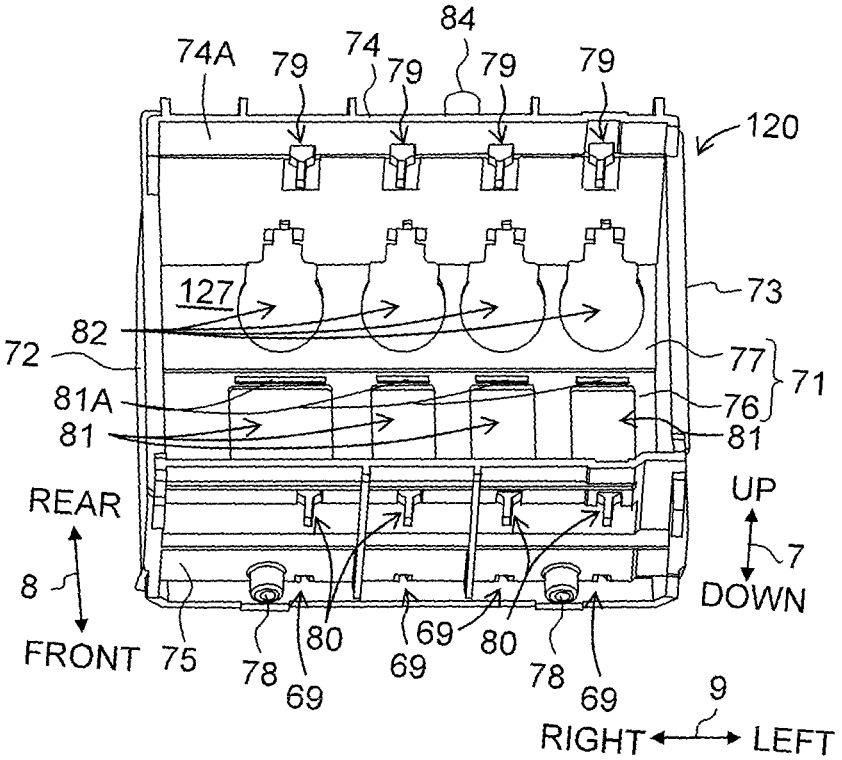
Figure 8:
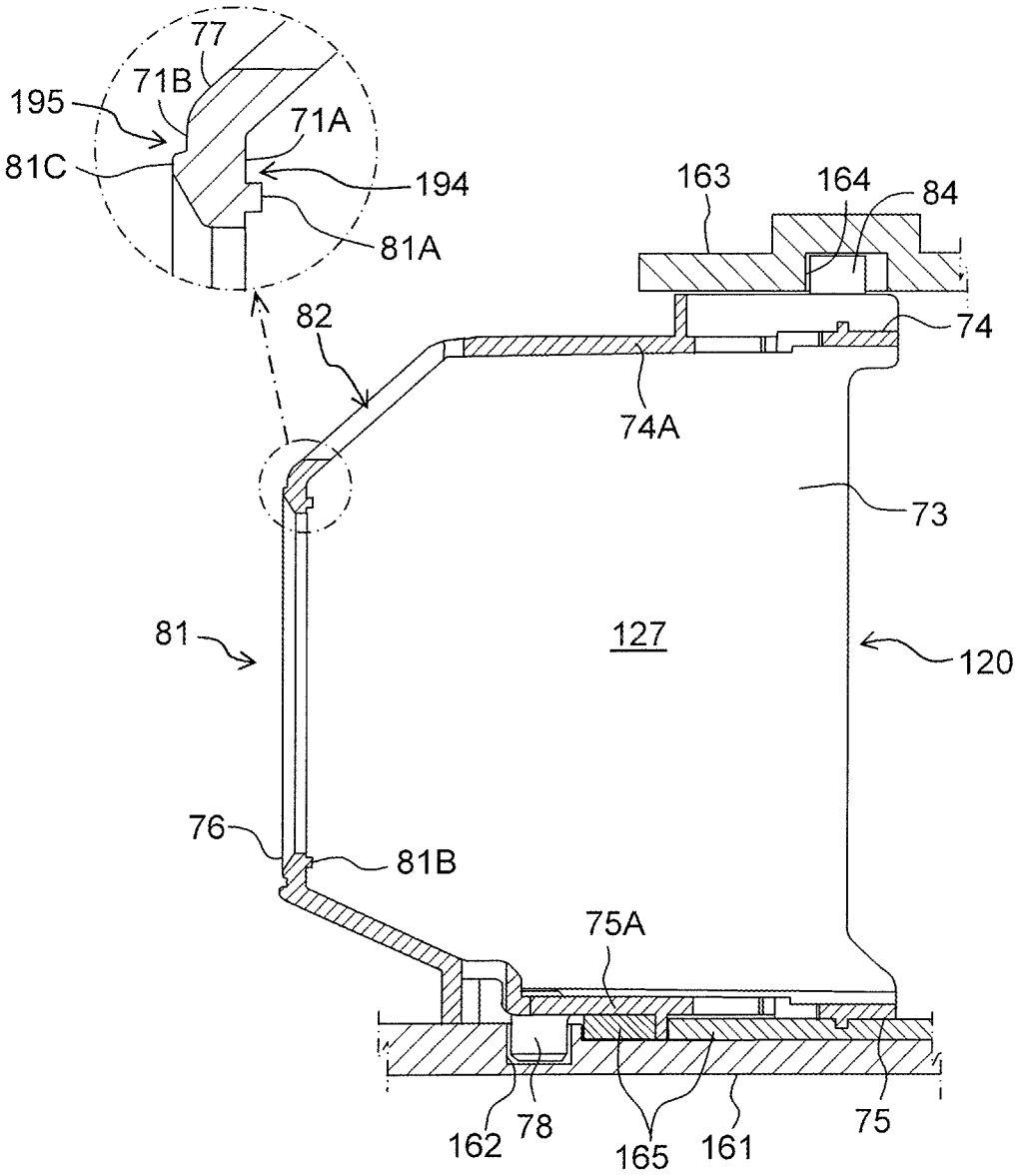
FIG. 8 is a partial vertical cross-sectional view of a casing and the holding member.

As depicted in FIGS. 7A, 7B and 8, the holding member 120 is provided with a front wall 71, a right wall 72, a left wall 73, an upper wall 74, and a lower wall 75.

The front wall 71 is formed of a standing wall 76 and an inclined wall 77 (an example of a cover inclined wall). The standing wall 76 expands in the up/down direction 7 and in the left/right direction 9. The inclined wall 77 connects the upper end of the standing wall 76 and the front end of the upper wall 74. The inclined wall 77 is inclined with respect to the up/down direction 7 and the front/rear direction 8.

The right wall 72 extends rearward from the right end of the front wall 71. The left wall 73 extends rearward from the left end of the front wall 71. The upper wall 74 extends rearward from the upper end of the front wall 71 (in detail, from the upper end of the inclined wall 77). The right end of the upper wall 74 is connected to the upper end of the right wall 72. The left end of the upper wall 74 is connected to the upper end of the left wall 73. The lower wall 75 extends rearward from the lower end of the front wall 71. The right end of the lower wall 75 is connected to the lower end of the right wall 72. The left end of the lower wall 75 is connected to the lower end of the left wall 73.

The lower wall 75 has cylindrical projections 78 formed thereon to extend downward. The projections 78 are formed respectively in a right end portion and a left end portion of the lower wall 75. As depicted in FIG. 8, each of the projections 78 is inserted in a hole 162 formed in a bottom plate 161 of the casing 14 of the printer unit 11.

The upper wall 74 has a cylindrical projection 84 formed thereon to extend upward. The projection 84 is formed in the vicinity of the center of the upper wall 74 according to the left/right direction 9. As depicted in FIG. 8, the projection 84 is inserted in a hole 164 formed in an intermediate plate 163 of the casing 14 of the printer unit 11. In this manner, the holding member 120 is fixed on and supported by the casing 14 to hold the ink tank 100.

An absorber 165 is provided between the holding member 120 and the bottom plate 161. The absorber 165 is formed of such a material as, for example, foamed polyurethane, felt, or the like, being capable of absorbing a liquid such as an ink and the like to retain or store the same.

As depicted in FIGS. 7A and 7B, an inner space 127 is formed in the holding member 120 by the front wall 71, the right wall 72, the left wall 73, the upper wall 74, and the lower wall 75. As depicted in FIG. 6, the four ink tanks 100B, 100Y, 100C, and 100M are inserted into the inner space 127 from the rear side. By virtue of this, the front portions of the four ink tanks 100B, 100Y, 100C, and 100M occupy the inner space 127.

As depicted in FIG. 7B, a plurality of openings 79 are formed in a rear portion of the upper wall 74. As depicted in FIG. 7A, a plurality of openings 80 and 69 are formed in a rear portion of the lower wall 75. The projections 108 of the ink tank 100 engage with the openings 79. The projections 109 of the ink tank 100 engage with the openings 80. The projections 131 and 132 of the ink tank 100 are in contact with the surface 74A of the upper wall 74 beside the inner space 127 while the projections 134 and 135 are in contact with the surface 75A of the lower wall 75 beside the inner space 127. By those engagements, the four ink tanks 100B, 100Y, 100C, and 100M are positioned against the holding member 120 to align in one row along the left/right direction 9.

With the ink tank 100 held by the holding member 120, the front wall 71 covers the front wall 101 of the ink tank 100, the upper wall 74 covers the front portion of the upper wall 104 of the ink tank 100, and the lower wall 75 covers the front portion of the lower wall 105 of the ink tank 100.

With the ink tank 100 held by the holding member 120, the right wall 72 covers the front portion (the right wall 159) of the right surface of the ink tank 100B arranged at the rightmost side among the four ink tanks 100 while the left wall 73 covers the front portion (the left wall 103) of the left surface of the ink tank 100M arranged at the leftmost side among the four ink tanks 100. That is, the holding member 120 partially covers the surfaces positioned outward along the left/right direction 9 (the right surface of the ink tank 100B and the left surface of the ink tank 100M) among the right surfaces and the left surfaces of the ink tanks 100B and 100M positioned at the left and right ends among the plurality of ink tanks 100 being held.

In the above manner, holding the ink tanks 100, the holding member 120 covers the front portions of the ink tanks 100.

As depicted in FIG. 7B, a plurality of openings 81 are formed in the standing wall 76 of the front wall 71 of the holding member 120. The plurality of openings 81 are formed at intervals along the left/right direction 9. The plurality of openings 81 correspond respectively to the four ink tanks 100B, 100Y, 100C, and 100M. That is, in the embodiment, the number of the formed openings 81 is four. While the respective openings 81 are rectangular in the embodiment, other shapes than rectangle may also be adopted.

With the ink tanks 100 held by the holding member 120, the standing wall 102 of the front wall 101 of each ink tank 100 is exposed to the outside of the holding member 120 through the opening 81. In detail, the front surface 102A of the standing wall 102 and the first line 146 and the second line 147 formed on the front surface 102A are exposed. Further, with the respective ink tanks 100 held by the holding member 120 and with the cover 70 at the closed position, the standing wall 102 of each ink tank 100 is exposed to the outside of the printer unit 11 through the opening 81 of the holding member 120 and through the opening 97 of the cover 70.

As depicted in FIGS. 7A, 7B and 8, in an upper peripheral portion and a lower peripheral portion of the periphery of each opening 81, a projection 81A (an example of the first projection) and a projection 81B (an example of the second projection) are formed respectively to project toward the inner space 127 of the holding member 120. With the respective ink tanks 100 held by the holding member 120, the standing wall 102 of the front wall 101 of each ink tank 100 is in contact with the projection 81A and the projection 81B of the periphery of the opening 81. By virtue of this, the front position of each ink tank 100 is determined against the holding member 120. As depicted in FIGS. 7A and 7B, in the up/down direction 7, the openings 81 are arranged between the projection 81A (an example of a first projection) and the projection 81B (an example of a second projection).

As depicted in FIG. 8, in the upper peripheral portion of the opening 81, a space 194 between the inner surface 71A of the front wall 71 and the projection 81A serves as an ink flow channel (an example of the first liquid flow channel) where the ink flows along the left/right direction 9. Namely, this ink flow channel (the first liquid flow channel) is constructed from the inner surface 71A of the front wall 71 and the projection 81A to extend in the left/right direction 9.

As depicted in FIGS. 6 and 8, in the upper peripheral portion, the lower peripheral portion, a right peripheral portion and a left peripheral portion of the periphery of each opening 81, a projection 81C is formed to project outward from an outer surface 71B of the front wall 71 of the holding member 120. The projection 81C is a continuous projecting ridge enclosing the periphery of the opening 81. A space 195 between the outer surface 71B of the front wall 71 and the part of the projection 81C extending along the left/right direction 9 is an ink flow channel (an example of the third liquid flow channel) where the ink flows along the left/right direction 9. Namely, this ink flow channel (the third liquid flow channel) is constructed from the outer surface 71B of the front wall 71 and such parts of the projection 81C as to extend in the left/right direction 9, to extend in the left/right direction 9. A space 196 between the outer surface 71B of the front wall 71 and the part of the projection 81C extending along the up/down direction 7 is an ink flow channel (an example of the fourth liquid flow channel) where the ink flows along the up/down direction 7. As depicted in FIG. 6, there is a pair of such parts of the projection 81C as to extend in the up/down direction 7, separately existing in the right peripheral portion and the left peripheral portion of the openings 81. Therefore, there is also a pair of ink flow channels (a fourth liquid flow channel) constructed from the outer surface 71B of the front wall 71 and the paired parts of the projection 81C extending in the up/down direction 7. These paired ink flow channels are arranged separately across the openings 81 in the left/right direction 9. Further, as depicted in FIG. 6, of the projection 81C, the part extending in the left/right direction 9 and the parts extending in the up/down direction 7 may be connected. Hence, the ink flow channel (the third liquid flow channel) extending in the left/right direction 9 and the ink flow channels (the fourth liquid flow channel) extending in the up/down direction 7, both of which are formed in the outer surface 71B of the front wall 7, may be connected.

As depicted in FIG. 7B, a plurality of openings 82 are formed in the inclined wall 77 of the front wall 71 of the holding member 120. The plurality of openings 82 are formed at intervals along the left/right direction 9. The plurality of openings 82 correspond respectively to the four ink tanks 100B, 100Y, 100C, and 100M. That is, in the embodiment, the number of the formed openings 82 is four. While the respective openings 82 are circular in the embodiment, other shapes than circle may also be adopted.

As depicted in FIG. 10, with the respective ink tanks 100 held by the holding member 120, the inlet 112 of each ink tank 100 is exposed to the outside of the holding member 120 through the opening 82. Therefore, the inlet 112 of each ink tank 100 is positioned above the opening 81 of the holding member 120.

As depicted in FIG. 7A, in a front portion of the upper wall 74 of the holding member 120, a cap fitting portion 155 is formed to fit an aftermentioned cap 113.

In the embodiment, as depicted in FIG. 7A, the cap fitting portion 155 is defined by ribs 151 and 152 extending in the left/right direction 9 and a plurality of ribs 153 extending in the front/rear direction 8. The rib 152 is formed in the rear of the rib 151. Interspaces 154 are formed in a plurality of places of the rib 151. The respective interspaces 154 are formed in the rear of the respective openings 82. The respective interspaces 154 have the same positions in the left/right direction 9 as the respective openings 82 in the left/right direction 9. Each of the ribs 153 connects the rib 151 and the rib 152. The respective ribs 153 are formed on the two opposite sides of the respective interspaces 154 in the left/right direction 9.

Further, as long as the cap 113 can be fitted thereto, the configuration of the cap fitting portion 155 is not limited to including the abovementioned ribs 151, 152, and 153.

As is comprehensible from FIGS. 8 and 10, in the embodiment, with the holding member 120 holding the respective ink tanks 100, when viewed from the side of the front wall 101 of the respective ink tanks 100, the inlets 112 of the respective ink tanks 100 are arranged to align with the openings 81 of the holding member 120 along the up/down direction 7. Then, the ink flow channel (the first liquid flow channel), which is constructed from the inner surface 71A of the front wall 71 and the projection 81A, and the ink flow channel (the third liquid flow channel), which is constructed from the outer surface 71B of the front wall 71 and the part of the projection 81C extending in the left/right direction 9, are arranged between the inlets 112 of the respective ink tanks 100 and the openings 81 of the holding member 120 in the up/down direction 7.

<Connecting Member 200>

Figure 9A:
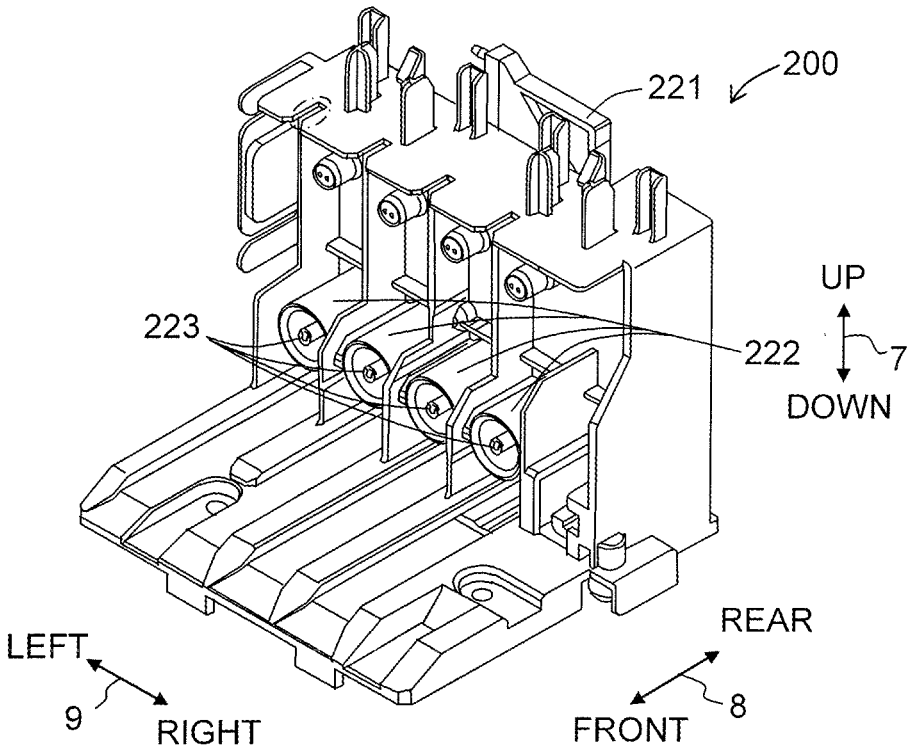
FIG. 9A is a front perspective view of a connecting member.
Figure 9B:
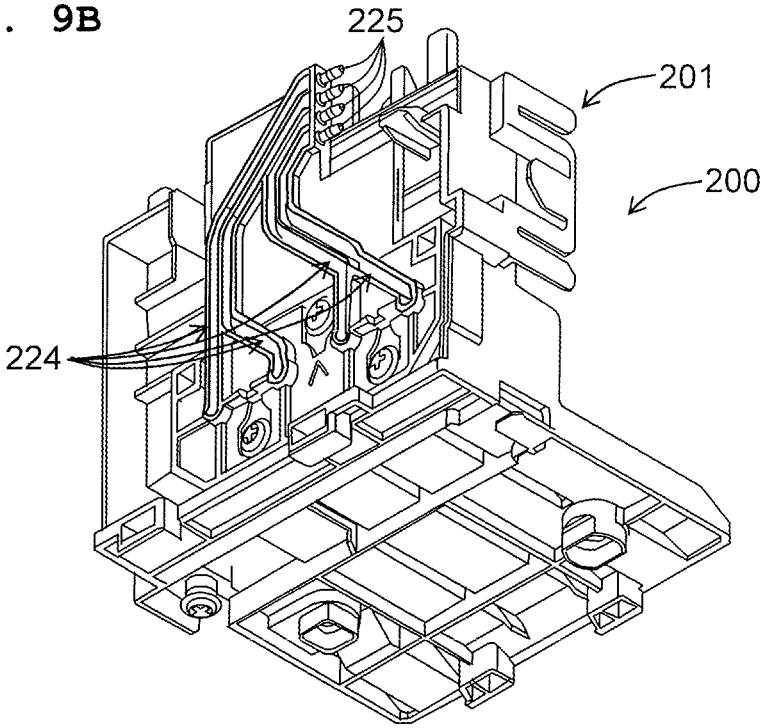
FIG. 9B is a rear perspective view of the connecting member.

As depicted in FIG. 6, the connecting member 200 holds the four ink tanks 100B, 100Y, 100C, and 100M aligned in one row in the left/right direction 9 from the rear side in the front/rear direction 8. The connecting member 200 has a supporting body 201 and a connecting portion 202. As depicted in FIGS. 9A and 9B, the connecting member 200 is configured by combining the connecting portion 202 with the supporting body 201 from the rear side. However, the supporting body 201 and the connecting portion 202 may be formed integrally.

The supporting body 201 is fixed on and supported by the casing 14. The connecting portion 202 has a connecting plate 221, guide cylinders 222, ink needles 223, ink flow channels 224, and joints 225.

Each of the guide cylinders 222 has a cylindrical shape and projects frontward from the connecting plate 221. The guide cylinders 222 accommodate the projecting portion 157 of the ink tank 100 in its inner space. The guide cylinder 222 positions the ink needle 223 and the through hole of the sealing member 160 by accommodating the projecting portion 157 when the ink needle 223 is inserted into the through hole of the sealing member 160.

In the inner space of the guide cylinder 222, the ink needle 223 is arranged coaxially with the guide cylinder 222. The ink needle 223 is a tube projecting frontward from the connecting plate 221. By inserting the ink needle 223 into the through hole of the sealing member 160 of the ink tank 100, the leading front end of the ink needle 223 comes into the inner space of the projecting portion 157. By virtue of this, the inner space of the ink needle 223 is communicated with the ink outflow channel 114. The rear end of the ink needle 223 is open at the rear side of the connecting plate 221.

Each of the ink flow channel 224 is formed in the rear side of the connecting plate 221. Each ink flow channel 224 is configured as an independent flow channel corresponding to each ink needle 223. With an unshown film sealing the open side (the rear side) of a groove formed in the rear side of the connecting plate 221, each ink flow channel 224 is formed. Each ink flow channel 224 is formed successively with the opening of the rear end of each ink needle 223. Further, the ink flow channels 224 are formed successively with the joints 225 formed in an upper portion of the connecting plate 221, respectively. The joints 225 are connected respectively with the ink tubes 32. With the connecting portion 202, ink flow channels are formed from the ink outflow channels 114 of the ink tanks 100 to communicate with the ink tubes 32.

<Cap 113>

As depicted in FIG. 6, the ink tank 100 is provided with caps 113B, 113Y, 113C, and 113M (which may be collectively referred to as "cap 113"). The ink tank 100 is provided with the four caps 113B, 113Y, 113C, and 113M to correspond to the four inlets 112B, 112Y, 112C, and 112M of the ink tank 100.

Each cap 113 is formed of a material capable of elastic deformation such as rubber, elastomer, or the like. Each cap 113 is provided with a cap portion 115, an elastic deformation portion 116, and a fitting portion 117. Further, each cap 113 is not limited to the configuration to be explained below.

The cap portion 115 has such an outer shape that a projection 115B projects from the center of a substantially disk-like disk portion 115A.

The elastic deformation portion 116 is belt-like. One end of the elastic deformation portion 116 is connected to the cap portion 115. The other end of the elastic deformation portion 116 is connected to the fitting portion 117. As depicted in FIG. 6, without any force applied from an external source, the elastic deformation portion 116 is in a state of extending substantially straight. One end of the elastic deformation portion 116 is formed with a projection 116A. The projection 116A projects in the opposite direction to the cap portion 115 across the elastic deformation portion 116.

The fitting portion 117 has such an outer shape that a projection 117B projects from a substantially cuboid rectangular portion 117A. The border between the rectangular portion 117A and the projection 117B is constricted. The projection 117B is shaped to correspond to the cap fitting portion 155 (the area defined by the ribs 151, 152, and 153; see FIG. 7A). That is, the projection 117B and the cap fitting portion 155 can fit together. Further, with the projection 117B and the cap fitting portion 155 fitting together, the border between the rectangular portion 117A and the projection 117B is situated inside the interspace 154. That is, with the projection 117B and the cap fitting portion 155 fitting together, the cap 113 is fitted to the holding member 120.

Fitted on the holding member 120, the cap 113 is movable between a sealing position depicted with a solid line in FIG. 10 and a separate position depicted with a broken line. With the projection 115B of the cap portion 115 attached tightly to the wall surface defining the periphery of each inlet 112, the cap at the sealing position seals the inlet 112 in a liquid-tightly manner. With the cap 113 at the sealing position, the elastic deformation portion 116 is curved into an arc-like shape. With the cap 113 at the separate position, the cap portion 115 is separate from the inlet 112. By virtue of this, the inlet 112 is opened. As a result, it is possible to inlet the ink to the ink chamber 111 through the inlet 112. With the cap 113 at the separate position, the elastic deformation portion 116 extends almost straight, restoring its elasticity.

For example, when the ink is inlet to the ink chamber 111 from the inlet 112 as depicted in FIG. 10, the ink may flow out of the inlet 112 onto the outer surface of the inclined wall 106 of the ink tank 100. The ink flowing out along the inclined wall 106 will flow in between the standing wall 102 (see FIG. 4) of the ink tank 100 and the inner surface 71A (see FIG. 8) of the front wall 71 of the standing wall 102, due to the gravity and the like. As depicted in FIG. 8, because the projection 81A is provided in the upper peripheral portion of the opening 81 of the holding member 120, the inflow ink flows in the left/right direction 9 along the space 194 (the first liquid flow channel) in the upper peripheral portion of the opening 81. The ink flowing to the left and right ends of the projection 81A flows downward in the place where the opening 81 is not provided, due to the gravity, on the inner surface 71A of the front wall 71, and flows below the holding member 120 from the openings 69 and 80 and the like (see FIG. 7B). The ink flowing below the holding member 120 is absorbed and stored by the absorber 165 (see FIG. 8).

Further, if, supposedly, the ink adheres to the outer surface 71B of the front wall 71 of the holding member 120 as depicted in FIG. 6, then that ink will flow downward due to the gravity and the like. Because the projection 81C is provided at the periphery of the opening 81, the ink flows in the left/right direction 9 along the space 195 (the third liquid flow channel) and the space 196 (the fourth liquid flow channel) of the periphery of the opening 81 on the outer surface 71B of the front wall 71, and then flows downward. The ink flowing below the holding member 120 is absorbed and stored by the absorber 165.

Functions and Effects of the Embodiment

According to the embodiment, for example, when the user inlets the ink into the inlet 112 of the ink tank 100, even if the ink flows out of the inlet 112, the ink flowing in between the front wall 101 of the ink tank 100 and the holding member 120 flows in the left/right direction 9 along the space 194 (the first liquid flow channel) in the upper peripheral portion of the opening 81. By virtue of this, the ink is less likely to flow to the exposed front wall 101 of the ink tank 100 through the opening 81 of the holding member 120. Especially, because the front wall 101 of the ink tank 100 is provided with the first line 146 and the second line 147, the ink will not contaminate the first line 146 and the second line 147, and it becomes easy to grasp the timing of supplementing the ink to the ink tank 100, and the upper limit amount of the ink storable in the ink tank.

Further, at the periphery of the opening 81 of the holding member 120, with the projection 81A and the projection 81B in contact (touch) with the front wall 101 of the ink tank 100, it is possible to parallel the front wall 101 of the ink tank 100 with the inner surface 71A of the front wall 71 of the holding member 120.

Further, because the projection 81C is provided on the outer surface 71B of the periphery of the opening 81 of the holding member 120, the ink flowing out onto the outer surface 71B of the holding member 120 flows along the projection 81C. Namely, the ink flowing out onto the outer surface 71B of the holding member 120 flows on in the left/right direction 9 along the space 195 (the third liquid flow channel), in the upper peripheral portion of the openings 81. Then, the ink flowing in the left/right direction 9 along the space 195 flows on in the up/down direction 7 along the space 196 (the fourth liquid flow channel). By virtue of this, the ink is less likely to flow to the exposed front wall 101 of the ink tank 100 through the opening 81 of the holding member 120.

Further, because the inlet 112 is provided in the inclined wall 106 of the ink tank 100, it becomes easy to adjust, to the inlet 112, the mouth or the like of the bottle storing the ink for supplement.

Further, because the holding member 120 covers the inclined wall 106 of the ink tank 100 and has the opening 82 exposing the inlet 112, the ink flowing out of the inlet 112 is less likely to flow onto the outer surface 71B of the holding member 120.

<Modifications>

Figure 11:
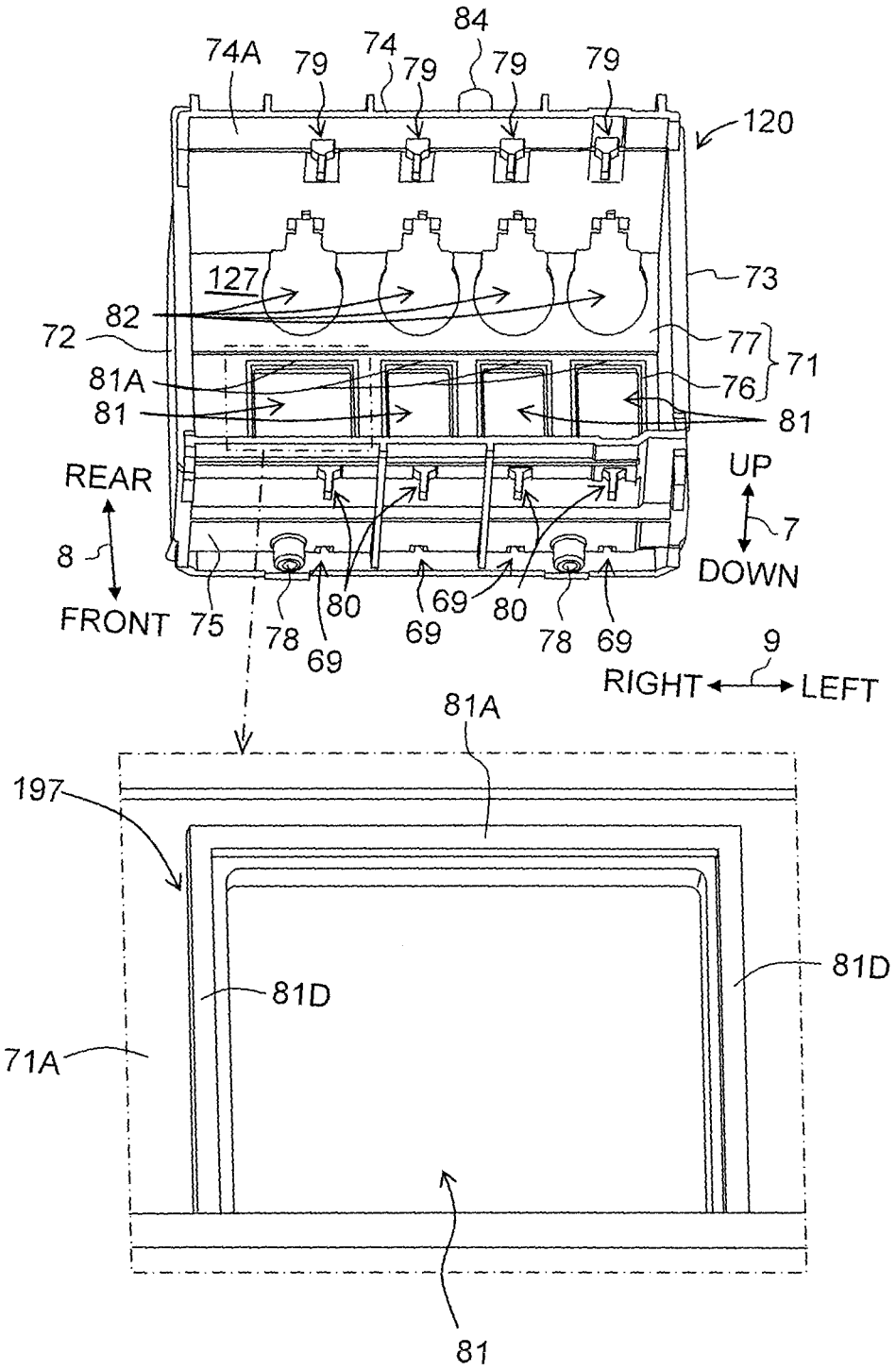
FIG. 11 is an enlarged perspective view of the holding member including projections in a right peripheral portion and a left peripheral portion of the periphery of an opening according to a modification.

In the aforementioned embodiment, the projection 81A and the projection 81B are formed in the upper peripheral portion and the lower peripheral portion of the periphery of the opening 81 of the holding member 120. As depicted in FIG. 11, a pair of projections 81D may be formed in a right peripheral portion and a left peripheral portion of the periphery of the opening 81. With spaces 197 between the projections 81D and the inner surface 71A of the front wall 71, a pair of ink flow channels (an example of the second liquid flow channel) are formed to extend along the up/down direction 7. By virtue of this, the ink flowing in the left/right direction 9 along the space 194 flows in the up/down direction 7 along the spaces 197. Thereby, the ink is even less likely to flow onto the exposed front wall 101 of the ink tank 100 through the opening 81 of the holding member 120.

As depicted in FIG. 11, the pair of second liquid flow channels, which are constructed from the inner surface 71A of the front wall 71 and the projections 81D, are arranged separately across the openings 81 in the left/right direction 9. Further, as depicted in FIG. 11, the projection 81A extending in the left/right direction 9 may be connected to the projections 81D extending in the up/down direction 7. Namely, the ink flow channel (the first liquid flow channel) constructed from the inner surface 71A of the front wall 71 and the projection 81A may be connected to the ink flow channels (the second liquid flow channel) constructed from the inner surface 71A of the front wall 71 and the projections 81D.

Figure 12:
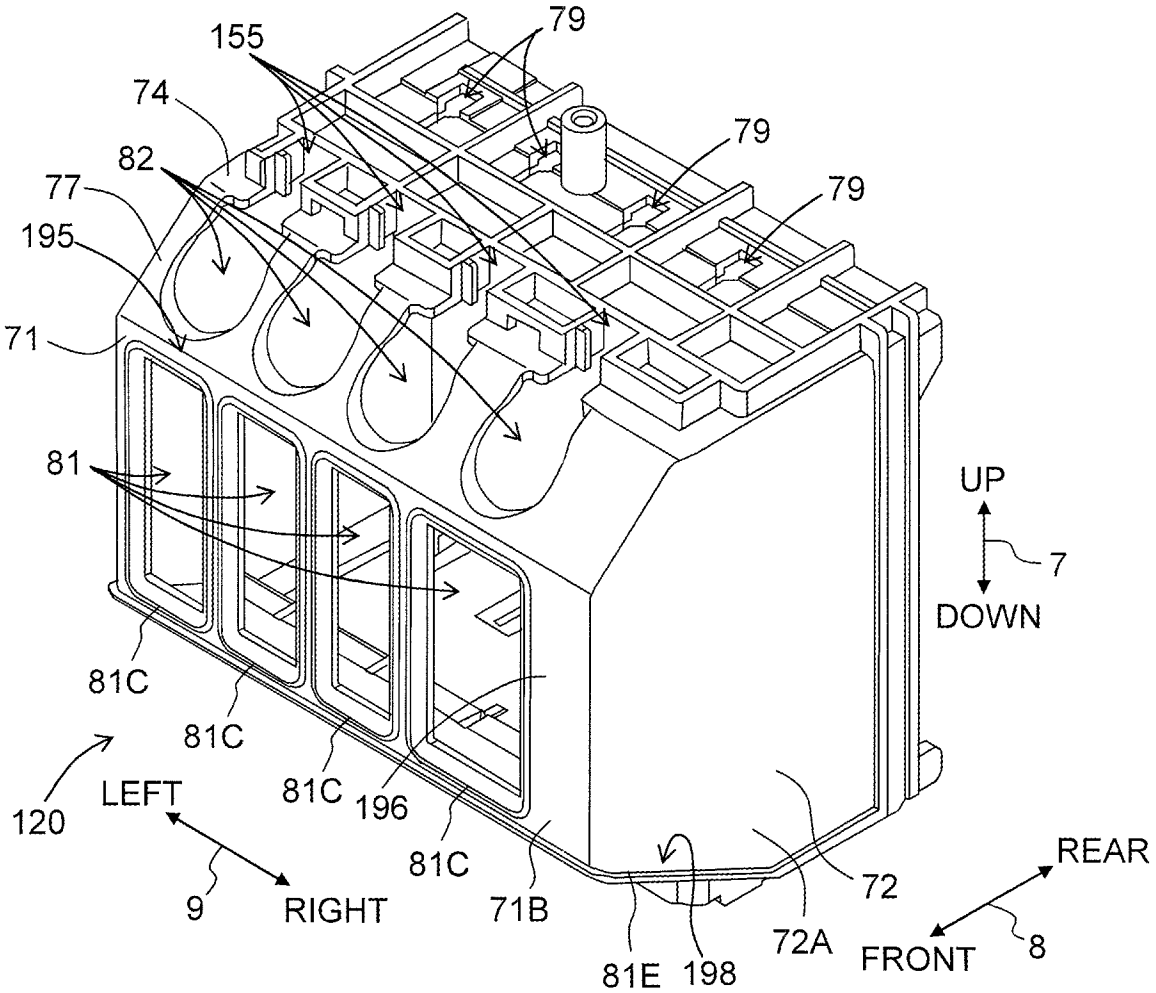
FIG. 12 is an enlarged perspective view of the holding member including a projection in a lower portion of the outer surface of a right wall of the holding member according to another modification.

Further, as depicted in FIG. 12, a projection 81E may be formed to extend obliquely rearward and downward in a lower portion of the outer surface 72A of the right wall 72 (an example of the cover side wall) of the holding member 120. With a space 198 between the projection 81E and the outer surface 72A of the right wall 72, an ink flow channel (an example of the fifth liquid flow channel) is formed to extend rearward and downward. By virtue of this, the ink flowing out onto the outer surface 72A of the holding member 120 flows rearward and downward along the space 198. The ink flowing below the holding member 120 is absorbed and stored by the absorber 165 (see FIG. 8). By virtue of this, the ink becomes less likely to flow onto the exposed front wall 101 of the ink tank 100 through the opening 81 of the holding member 120. As depicted in FIG. 12, the ink flow channel (the fifth liquid flow channel) constructed from the outer surface 72A of the right wall 72 and the projection 81E is inclined with respect to the front/rear direction 8 and the up/down direction 7, and extends in such a manner that the farther away from the front wall 71 of the holding member 120 (an example of a cover front wall), the farther away from the inlet 112 of the ink tank 100.

Further, in the above embodiment and modification, the ink flow channels are formed of the spaces 194 to 198 formed between the projections and the surfaces. The projections include the projections 81A and 81C to 81E, and the surfaces include the inner surface 71A, the outer surface 71B, and the outer surface 72A. However, ink flow channels may be configured by recessed grooves formed by, for example, the inner surface 71A, the outer surface 71B or the outer surface 72A, instead of the projections 81A and 81C to 81E.

Further, in the aforementioned embodiment, the ink is taken as an example of liquid for the explanation. However, the present teaching is not limited to this. That is, instead of the ink, an example of liquid may be a pretreatment liquid to be jetted to recording paper before an ink is jetted for printing, or water and the like sprayed in the vicinity of the nozzles 40 of the recording head 39 for preventing the nozzles 40 of the recording head 39 from drying.

What is claimed is:

1. A supply apparatus comprising:

a tank having: a liquid storing chamber, an inlet via which liquid is poured into the liquid storing chamber, and a liquid supply portion for causing the liquid to flow out of the liquid storing chamber, the liquid storing chamber being defined by a pair of first surfaces facing each other in a first direction, a front wall connecting the pair of first surfaces and a rear wall which is separated from the front wall in a second direction orthogonal to the first direction and which connects the pair of first surfaces; and a cover covering a part of the tank including the front wall, and being formed with an opening to partially expose the front wall of the tank, wherein when the supply apparatus is viewed from the front wall side of the tank, the inlet of the tank and the opening of the cover are arranged to align in a third direction orthogonal to the first direction and the second direction, the cover has an inner surface facing the front wall of the tank and a first liquid flow channel formed in the inner surface at a periphery of the opening, the first liquid flow channel being arranged between the inlet and the opening in the third direction.

2. The supply apparatus according to claim 1, wherein the first liquid flow channel extends in the first direction.

3. The supply apparatus according to claim 1, wherein the cover further has a pair of second liquid flow channels formed in the inner surface at the periphery of the opening, and the pair of second liquid flow channels are arranged separately across the opening in the first direction.

4. The supply apparatus according to claim 3, wherein the pair of second liquid flow channels extend in the third direction, respectively.

5. The supply apparatus according to claim 3, wherein the first liquid flow channel is connected to the pair of second liquid flow channels.

6. The supply apparatus according to claim 1, wherein the cover has a first projection projecting from the inner surface toward the tank to contact with the front wall of the tank, and the first liquid flow channel is constructed from the inner surface and the first projection.

7. The supply apparatus according to claim 6, wherein the first projection extends in the first direction.

8. The supply apparatus according to claim 6, wherein the cover further has a second projection projecting from the inner surface toward the tank to contact with the front wall of the tank, and the opening is arranged between the first projection and the second projections in the third direction.

9. The supply apparatus according to claim 1, wherein the cover further has an outer surface on the other side of the inner surface and a third liquid flow channel formed in the outer surface at a periphery of the opening, and the third liquid flow channel is arranged between the inlet and the opening in the third direction.

10. The supply apparatus according to claim 9, wherein the third liquid flow channel extends in the first direction.

11. The supply apparatus according to claim 9, wherein the cover further has a pair of fourth liquid flow channels formed in the outer surface at the periphery of the opening, and the pair of fourth liquid flow channels are arranged separately across the opening in the first direction.

12. The supply apparatus according to claim 11, wherein the pair of fourth liquid flow channels extend in the third direction, respectively.

13. The supply apparatus according to claim 11, wherein the third liquid flow channel is connected to the pair of fourth liquid flow channels.

14. The supply apparatus according to claim 1, wherein the cover has a cover front wall covering the front wall of the tank and being formed with the opening to partially expose the front wall of the tank; a cover side wall covering at least part of the first surface of the tank and being connected to the cover front wall of the cover; and a fifth liquid flow channel formed in an outer surface, of the cover side wall, not facing the first surface of the tank; and the fifth liquid flow channel is inclined with respect to the second direction and the third direction and extends such that the farther away from the cover front wall of the cover, the farther away from the inlet of the tank.

15. The supply apparatus according to claim 1, wherein in an exposed part of the front wall of the tank through the opening of the cover, a first mark is provided at a first position and a second mark is provided at a second position, the first position corresponding to a liquid surface when a first amount of the liquid is stored in the liquid storing chamber, the second position corresponding to a liquid surface when a second amount of the liquid is stored in the liquid storing chamber, and the second amount being less than the first amount.

16. The supply apparatus according to claim 1, wherein the tank further has an inclined wall which is formed successively with the front wall and is inclined with respect to the second direction and the third direction;

when the supply apparatus is viewed from the front wall side of the tank, the front wall and the inclined wall are arranged to align in the third direction; and the inlet is formed in the inclined wall.

17. The supply apparatus according to claim 16, wherein the cover further has a cover inclined wall covering the inclined wall, and the cover inclined wall is formed with an opening through which the inlet is exposed.

18. The supply apparatus according to claim 1, wherein the liquid is an ink for ink jet recording, and the supply apparatus is configured to supply a recording head with the ink for ink jet recording in the tank.

* * * * *